US006041795A

United States Patent [19]

Steiner

[11] Patent Number: 6,041,795

[45] Date of Patent: Mar. 28, 2000

[54] COMPUTER CONTROLLED, MULTI-BAY ULTRASONIC GOLF CLUB CLEANING MACHINE

[76] Inventor: Sidney B. Steiner, 905 S. Broad St., New Orleans, La. 70125

[21] Appl. No.: 09/060,785

[22] Filed: Apr. 15, 1998

[51] Int. Cl.[7] ..... B08B 3/10

[52] U.S. Cl. ..... 134/56 R; 134/113; 134/105; 134/184; 134/57 R

[58] Field of Search ..... 134/58 R, 113, 134/184, 186, 105, 57 R, 84, 56 R

[56] References Cited

U.S. PATENT DOCUMENTS

| | | | |
|---|---|---|---|
| 3,101,089 | 8/1963 | Brown | 134/186 |
| 3,191,913 | 6/1965 | Mettler . | |
| 3,207,165 | 9/1965 | Durrant | 135/58 |
| 3,573,862 | 4/1971 | Brown | 134/57 |
| 3,709,732 | 1/1973 | Thomen . | |
| 3,746,020 | 7/1973 | Pekosh . | |
| 4,333,485 | 6/1982 | Karlsson et al. . | |
| 4,334,143 | 6/1982 | Cushing | 219/333 |
| 4,409,999 | 10/1983 | Pedziwatr . | |
| 4,582,077 | 4/1986 | Gabriel et al. . | |
| 4,757,831 | 7/1988 | Ingermann et al. . | |
| 4,886,082 | 12/1989 | Kato et al. . | |
| 4,895,176 | 1/1990 | Ohtsuka et al. . | |
| 4,951,339 | 8/1990 | Braun . | |
| 5,114,494 | 5/1992 | Remec . | |
| 5,141,009 | 8/1992 | Morantz | 134/57 R |
| 5,168,888 | 12/1992 | Atwasser | 134/181 |
| 5,224,233 | 7/1993 | Rich . | |
| 5,385,160 | 1/1995 | Brinkman | 134/186 |
| 5,494,063 | 2/1996 | Suzuki et al. . | |
| 5,501,240 | 3/1996 | Dohku et al. . | |
| 5,849,104 | 12/1998 | Mohindra | 134/25.4 |

*Primary Examiner*—Frankie L. Stinson
*Attorney, Agent, or Firm*—Garvey, Smith, Nehrbass & Doody, L.L.C.

[57] ABSTRACT

Apparatus for and method of cleaning golf clubs (including grips and club heads) using an ultrasonic golf club cleaning machine including four bays to allow a complete foursome to clean the clubs simultaneously while they are waiting for their turn to play golf.

24 Claims, 18 Drawing Sheets

COMPUTER CONTROLLED, MULTI-BAY ULTRASONIC GOLF CLUB CLEANING MACHINE

CROSS-REFERENCE TO RELATED APPLICATIONS

Priority of U.S. Provisional Patent Application Serial No. 60/042,313, filed Apr. 15, 1997, incorporated herein by reference, is hereby claimed.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION

Field of the Invention

The present invention relates to golf club cleaning machines. More particularly, the present invention relates to ultrasonic golf club cleaning machines. 2. General Background of the Invention Typical golf club cleaning machines contain a single bay, allowing only one set of clubs to be cleaned at a time.

The following U.S. Patents are incorporated herein by reference: U.S. Pat. Nos.: 5,141,009; 3,709,732; 3,101,089; 5,385,160; 5,168,888; 4,757,831; 4,951,339; 5,224,233.

U.S. Pat. No. 5,385,160 discloses a cabinet to accept golf club or clubs to be cleaned by ultrasonic vibration of a fluid.

U.S. Pat. No. 5,141,009 discloses an ultrasonic golf club cleaning cabinet.

U.S. Pat. No. 3,101,089 discloses an ultrasonic golf club cleaning machine for cleaning multiple clubs.

BRIEF SUMMARY OF THE INVENTION

The apparatus of the present invention solves the problems confronted in the art in a simple and straightforward manner. What is provided is an apparatus for and method of cleaning golf clubs (grips and club heads) using a computer-controlled ultrasonic golf club cleaning machine including four bays to allow a complete foursome to clean the clubs simultaneously while they are waiting for their turn to play golf or after they have played. The apparatus is preferably computer controlled.

The present invention includes (preferably computer controlled) apparatus for cleaning golf equipment including multiple (preferably four) bays for containing water and chemical cleaning agents; ultrasonic equipment for ultrasonically agitating devices placed in the bays; heating means for heating water in the bays; and activating means for activating the ultrasonic equipment. Preferably, the invention also includes means for determining a proper temperature for the bays, a ready light which comes on when all bays that can be operated are at a proper temperature, and means for rejecting tokens when the ready light is not on. The invention can also include computer controlled means for determining the next available bay and for starting a lighted button above the bay to flash. Preferably, the invention includes computer controlled means for constantly maintaining the bays at a full level with water and chemical.

Preferably, the invention also includes computer controlled means for automatically filling and draining the bays in response to a key switch. It can also be set to be automatically turned on in the morning and turned off in the evening at pre-set times. The invention can also include computer means for automatically taking a defective bay out of service and eliminating the possibility of a token turning on this bay or a green light above it. Preferably, each bay is of a sufficient size to hold a full set of golf clubs. Preferably, all bays can run simultaneously. Preferably, there are control means for operating the bays independently of one another, such as for example turning on and shutting off the bays independently of one another.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

A Detailed Description of how the Milti-Bay, Dual Microprocessor (Computer) Controlled Ultrasonic Golf Club Cleaner of the Present Invention Works The multi-bay, dual microprocessor (computer) controlled ultrasonic golf club cleaner of the present invention enables a complete foursome (four golfers) to clean their entire sets of golf clubs simultaneously in four independent ultrasonic cleaning bays.

Figure 6B:
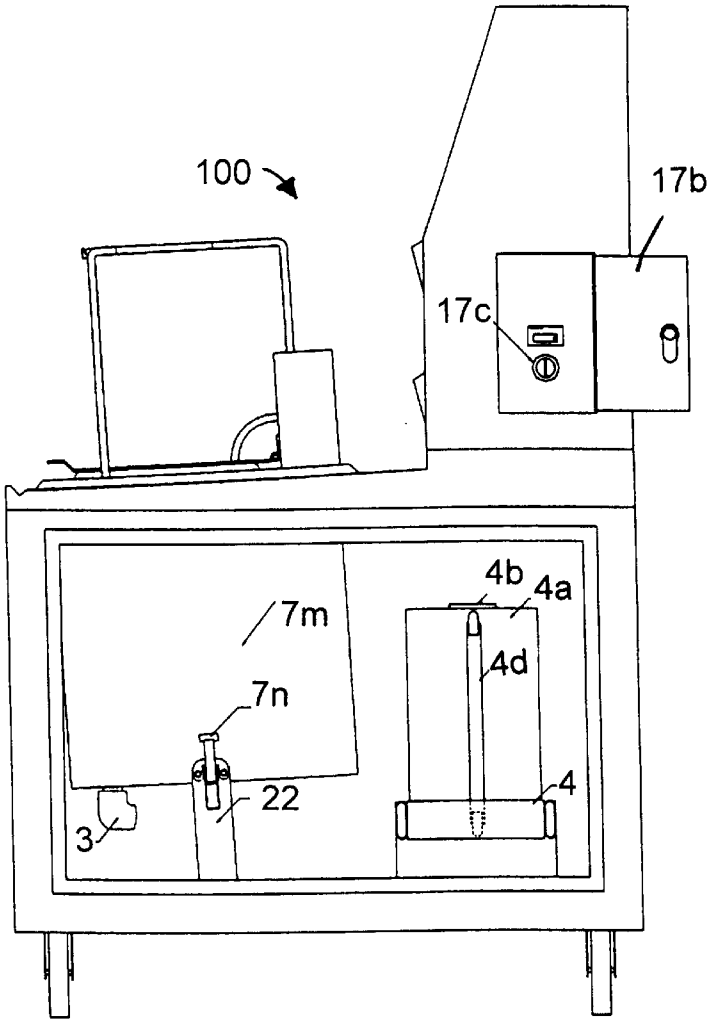
FIG. 6B is a right side view of the preferred embodiment of the apparatus of the present invention with the side panel removed.
Figure 6A:
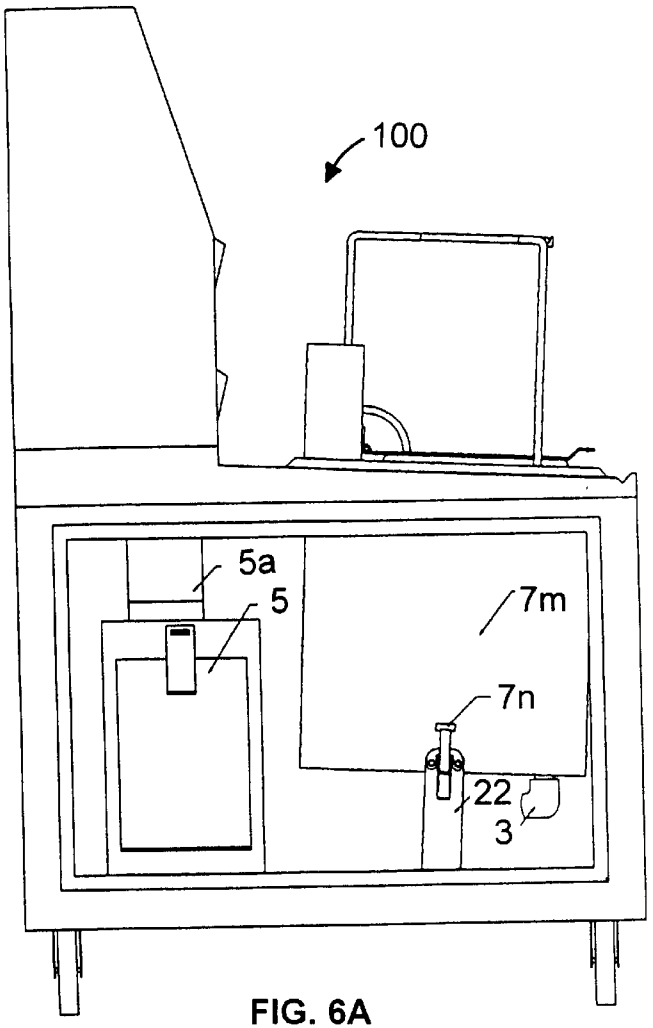
FIG. 6A is a left side view of the preferred embodiment of the apparatus of the present invention with the side panel removed.
Figure 7:
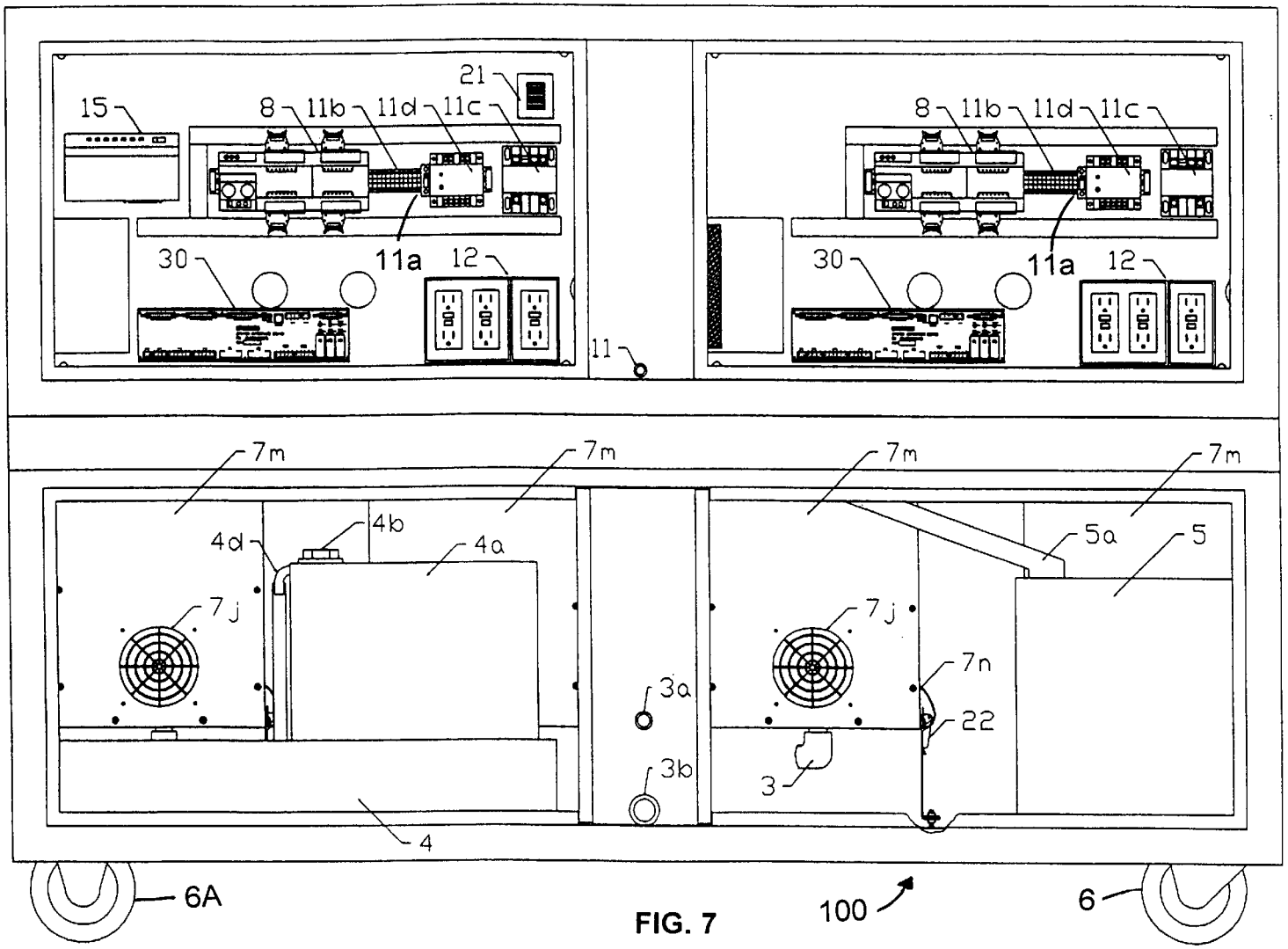
FIG. 7 is a rear view of the preferred embodiment of the apparatus of the present invention with the doors removed.

In operation, The unit 100 is plugged into a standard 120 volt/15 amp electric receptacle 11 (see FIG. 7), connected to water 3*a*, connected to a drain 3*b* and into a dedicated phone line 15. The unit is turned on, either automatically by the microprocessors (computers) 8/system interface boards 30 (FIG. 7) or manually 17*c* (FIG. 6B) by the golf facility.

Figure 2:
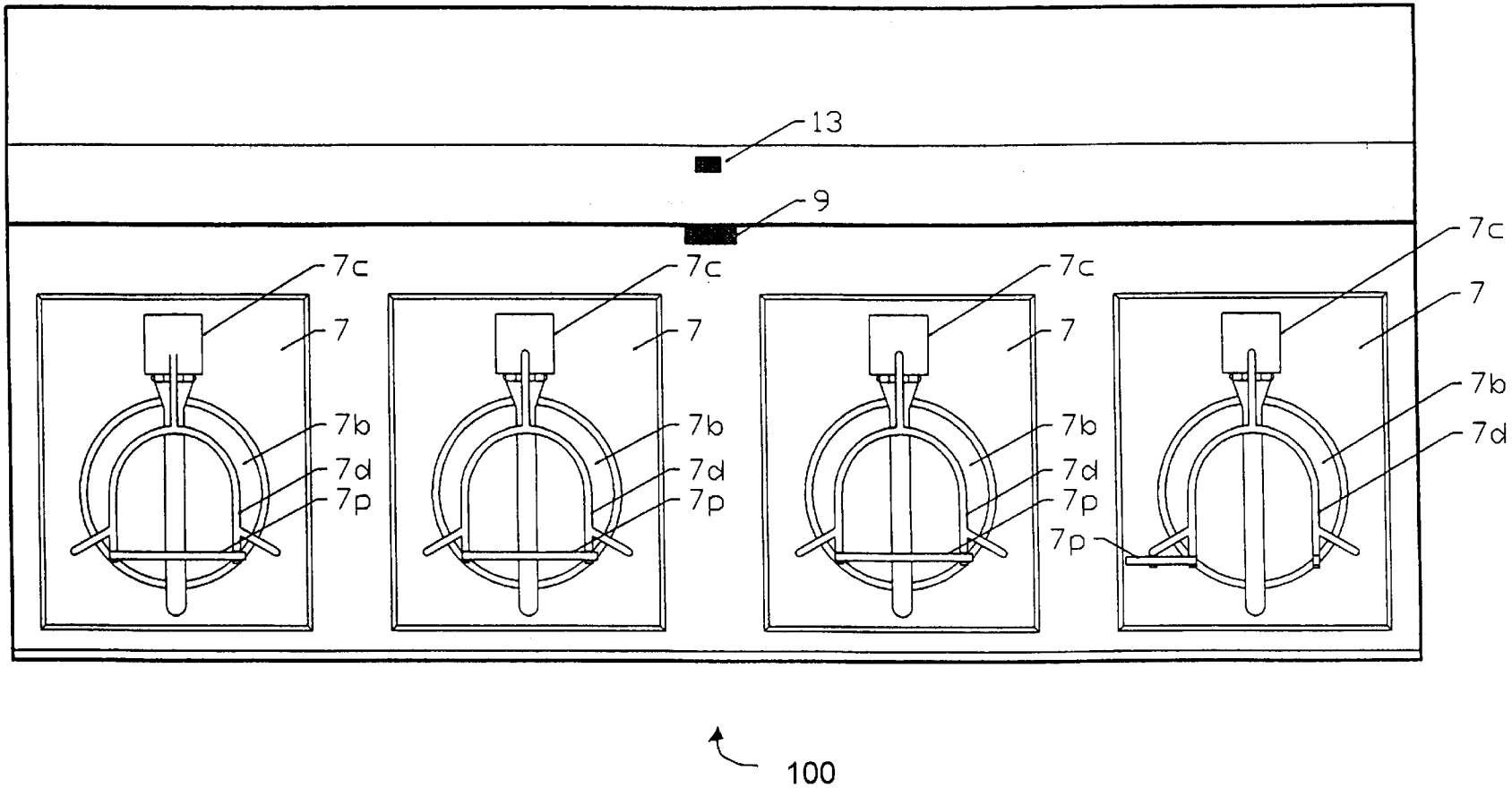
FIG. 2 is a top view of the preferred embodiment of the apparatus of the present invention.

There are two microprocessors (computers) 8/system interface boards 30 (FIG. 7), each microprocessors (computer) 8/system interface board 30 controlling two modular bays 7 (FIG. 2).

Figure 1:
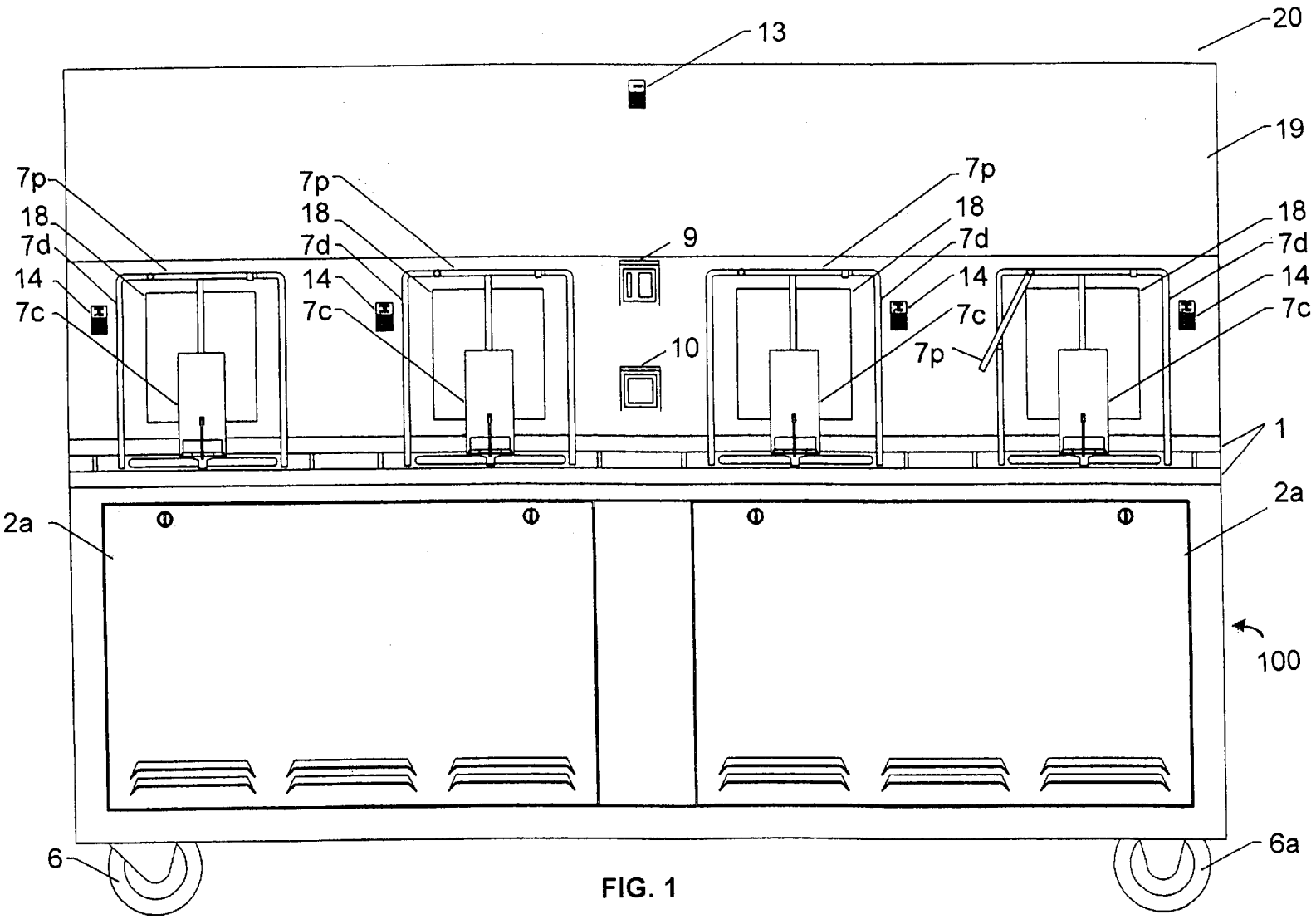
FIG. 1 is a front view of the preferred embodiment of the apparatus of the present invention.

The token taker 9 (FIG. 2), the soap reservoir 4*a* (FIG. 7), the READY light 13 (FIG. 1), the electrical power connection 11 (FIGS. 4, 7), the inlet water connection 3*a* (FIGS. 4, 7), the drain 3*b* (FIGS. 4, 7) and the modem/dedicated telephone line 15 are shared by both microprocessors (computers) 8/system interface boards 30.

Only a failure of the main electrical power 11, an extended failure of the water supply 3*a*, failure of the token taker 9, a low chemical reservoir 4*a*, or failure of both microprocessors (computers) 8/system interface boards 30 will disable the entire unit.

Once the unit is turned on, the microprocessors (computers) 8/system interface boards 30 begin the fill cycle by opening the fill solenoid 3*d* (FIG. 15), allowing the unit 100 to accept water.

The unit begins to fill with water. All four bays 7 and the leveling device 3*e* (FIGS. 18A and 18B) fill at the same time. As the unit 100 fills with water, the microprocessors (computers) 8/system interface boards 30 will signal the light/buttons illuminated push buttons 14 (FIG. 1) to blink in a scrolling sequence from right to left.

The water passes through the chemical injectors 3*f* (FIG. 15) which inject a preset amount of an ultrasonic cleaning chemical (commercially available from Intercon) from the chemical reservoir into the water as the water is filling each bay 7 and the leveling device 3*e*. If there is a low level of chemical in the chemical reservoir 4*a*, the microprocessors (computers) 8/system interface boards 30 will stop the filling of the unit and indicate the failed condition.

As bays 7 fill past the minimum operating level an electronic detector 3*g* (FIG. 18A) on each of the leveling devices 3*e* signals the microprocessors (computers) 8/system interface boards 30 which turns on the heater bands 7*e* (FIG. 11A) on the bays 7 to begin heating the water/chemical solution.

When the predetermined maximum water level is reached the high level electronic detector 3*t* (FIGS. 18A, 18B, 18C) on each of the leveling devices 3*e* signals the microprocessors (computers) 8/system interface boards 30 to close the fill solenoids 3*d*.

The "READY" light 13 (FIG. 1) is turned on by the microprocessors (computers) 8/system interface boards 30 once any single bay 7 is filled with water and the temperature in that bay 7 has reached a predetermined minimum temperature. The temperature sensor 7*x* (FIG. 11A) signals the microprocessors (computers) 8/system interface boards 30 when the minimum temperature level has been reached. The sensor 7*x* on the bay 7 signals the microprocessors (computers) 8/system interface boards 30 to shut off the heater strap 7*e* when the temperature reaches the predetermined maximum temperature. A fail/safe cut out 7*y* (FIG. 11A) on each bay will shut off the heater band 7*e* at a predetermined maximum temperature if the temperature sensor 7*x* fails. The microprocessors (computers) 8/system interface boards 30 will make available for use only those bays 7 that meet these criteria.

Instructions/Warnings 18 (FIG. 1) are above each bay 7 and next to each light/button (illuminated push button) 14 guiding golfers through the operation of the unit 100. These instructions will indicate that each of the following will be indicated/marked on the unit 100 by the following numbers:

"READY" light 13 will be indicated with a #1;

Token Slot/Taker 9 will be indicated with a #2; and

Light/Buttons (illuminated push buttons) 14 will be indicated with a #3.

Figure 3B:
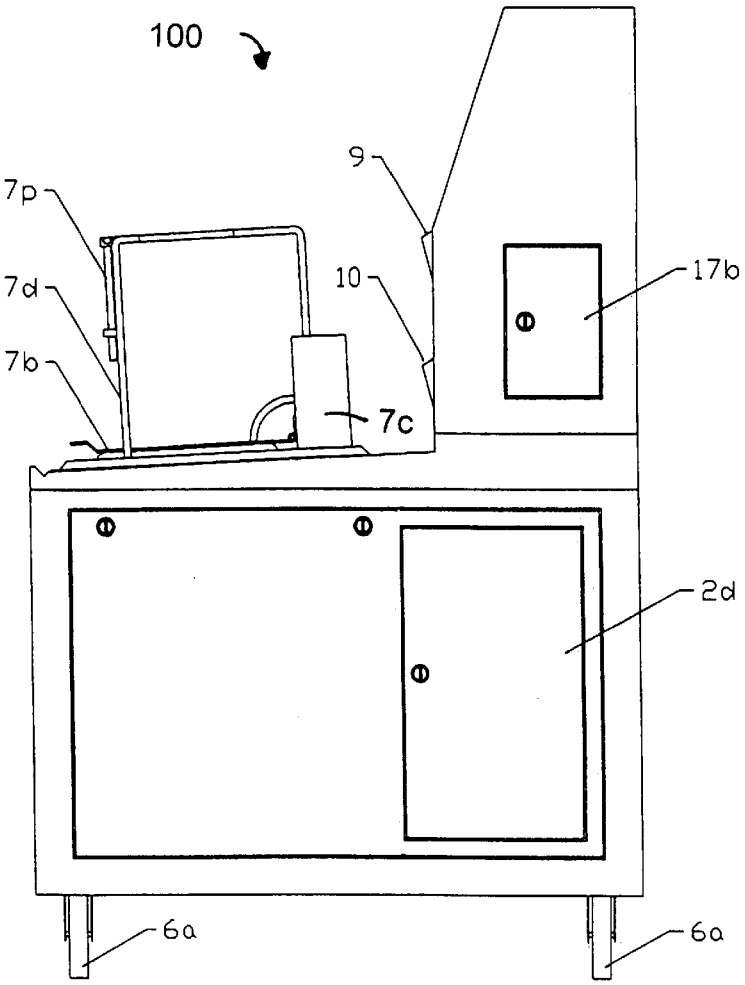
FIG. 3B is a right side view of the preferred embodiment of the apparatus of the present invention.
Figure 3A:
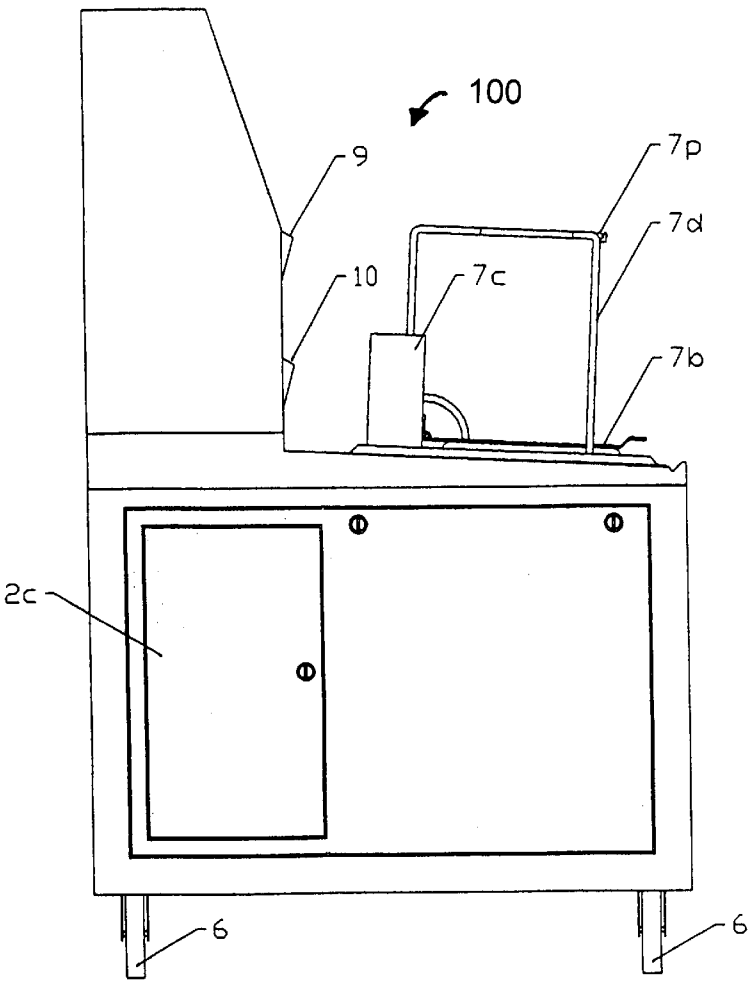
FIG. 3A is a left side view of the preferred embodiment of the apparatus of the present invention.

The golfer inserts a token into the token slot/taker 9 (FIGS. 2, 3A, 3B).

The preprogrammed token slot/taker 9 is controlled by the microprocessors (computers) 8/system interface boards 30 to accept the token only when the READY light 13 is on.

Only a token of a preset thickness, diameter and weight will be accepted by the token slot/taker 9.

If the unit is not in the "READY" mode (at least one bay 7 available for cleaning) the "READY" light 13 will not be on and the microprocessors (computers) 8/system interface boards 30 will signal the token slot/taker 9 to return the token to the golfer through the token return slot 10 (FIGS. 3A and 3B).

Once a token has been accepted, the microprocessors (computers) 8/system interface boards 30 will have one of the four light/buttons (illuminated push buttons) 14 begin to blink and the chime 21 (FIG. 7) will sound once indicating that this is the bay 7 to be used. At the same time, the microprocessors (computers) 8/system interface boards 30 will signal the lid device 7*c* (FIG. 2) to release the lid 7*b* enabling the golfer to open the lid 7*b*. Each lid device 7*c* keeps that lid 7*b* closed until they have been indicated for use by the microprocessors (computers) 8/system interface boards 30.

The microprocessors (computers) 8/system interface boards 30 rotate through the available bays 7 enabling bays 7 sequentially to prevent excessive use of one bay 7.

If a bay 7 is not operable, the microprocessors (computers) 8/system interface boards 30 will skip over this bay 7.

A bay 7 is not operable if water temperature is not within a preset range. A bay 7 is not operable if the transducer array 7*f* (FIG. 11A) is not functioning properly. Either of these will make a bay 7 unavailable.

The golfer places all clubs into the tank 7*a* (FIG. 11A) and places the opposite end of each club into the brackets 7*d* (FIGS. 1, 2) above the bay 7.

If cleaning grips and club heads, the grips are placed into the bay 7 first with the club heads/shafts inside the bracket 7*d*.

The golfer presses the blinking light/button (illuminated push button) 14 above that bay 7.

The microprocessors (computers) 8/system interface boards 30 will keep the light/button (illuminated push button) 14 glowing continually but will stop it from blinking.

The microprocessors (computers) 8/system interface boards 30 will start the cleaning process in this bay 7 by turning on the transducer array 7*f*.

The bay 7 will clean for approximately 15 to 20 seconds. The bay 7 will be turned off by the microprocessors (computers) 8/system interface boards 30. The microprocessors (computers) 8/system interface boards 30 will signal the light/button (illuminated push button) 14 to blink and the chime 21 to sound twice.

If cleaning grips, the golfer will take the grips out of the tank 7*a*, place the club heads in the tank 7*a* with the grips/shafts inside the bracket 7*d*. The golfer may begin to dry the grips.

If cleaning club heads only, the golfer does nothing at this time.

After 20 seconds of pause, the microprocessors (computers) 8/system interface boards 30 will start the cleaning process again in this bay 7, and will switch the light/button (illuminated push button) 14 from the blinking mode to the continuously on mode and the chime 21 will sound once.

After the cleaning process is complete (the time is preset by the microprocessors (computers) 8/system interface boards 30), the microprocessors (computers) 8/system interface boards 30 will turn off the bay 7, turn off the light/button (illuminated push button) 14, sound the chime 21 three times and enable the lid 7*b* to be released by the lid device 7*c* (after approximately one minute) and closed after the clubs have been removed from the tank 7*a* and the bracket 7*d*.

As the level of water is lowered in each tank 7*a* from use, evaporation and/or splashing, the microprocessors (computers) 8/system interface boards 30 will be signaled by an electronic detector 3*g* on the leveling device 3*e* to automatically fill the tanks 7*a* back up to their desired level with chemical being automatically injected by the chemical injector 3*f* into this water as it is filling the tanks 7*a*.

At the end of the day, or whenever the unit 100 is turned to the drain mode, either automatically by the microprocessors (computers) 8/system interface boards 30 or manually 17*c* by the golf facility, the following is controlled by the microprocessors (computers) 8/system interface boards 30: the READY light 13 is turned off; the fill solenoids 3*d* remain inhibited (closed); the drain valves 3*h* one valve for each 2 bays are opened; each bay 7 and the leveling device 3*e* are completely drained; as draining is taking place the light/buttons (illuminated push buttons) 14 will be signaled by microprocessors (computers) 8/system interface boards 30 to blink in a scrolling sequence (from left to right).

After the draining cycle is complete the unit 100 is shut off by the microprocessors (computers) 8/system interface boards 30.

If the unit 100 is to be moved, the unit 100 is disconnected from power 11, water 3*a* and telephone connections 15, and either towed by golf cart or pushed manually to a storage facility.

The modem 15 in the unit is operable at any time the unit is corrected to power and a telephone line.

The microprocessors (computers) 8/system interface boards 30 will signal the modem 15 to dial a preset telephone number whenever a failure (this includes a failure of any one bay 7), low chemical and or loss of one microprocessor (computer) 8/system interface board 30 is detected. The microprocessors (computers) 8/system interface boards 30 will send a message to this preset telephone number indicating that there is a problem with this particular unit.

CLEAN CLUBS CORPORATION will be able to dial into the modem 15 at any time to run a diagnostic check as well as query the internal counter to get a reading on the number of times the unit was used. This will enable CLEAN CLUBS CORPORATION to bill the golf facility without having to be present on site or depend on the golf facility to take a reading.

A Detailed Description of the Multi-Bay, Dual Microprocessor (Computer) Controlled Ultrasonic Golf Club Cleaner of the Present Invention

I. Lower Section A

The deck 1, made entirely of stainless steel, houses 4 modular bays 7 as described below.

Figure 4:
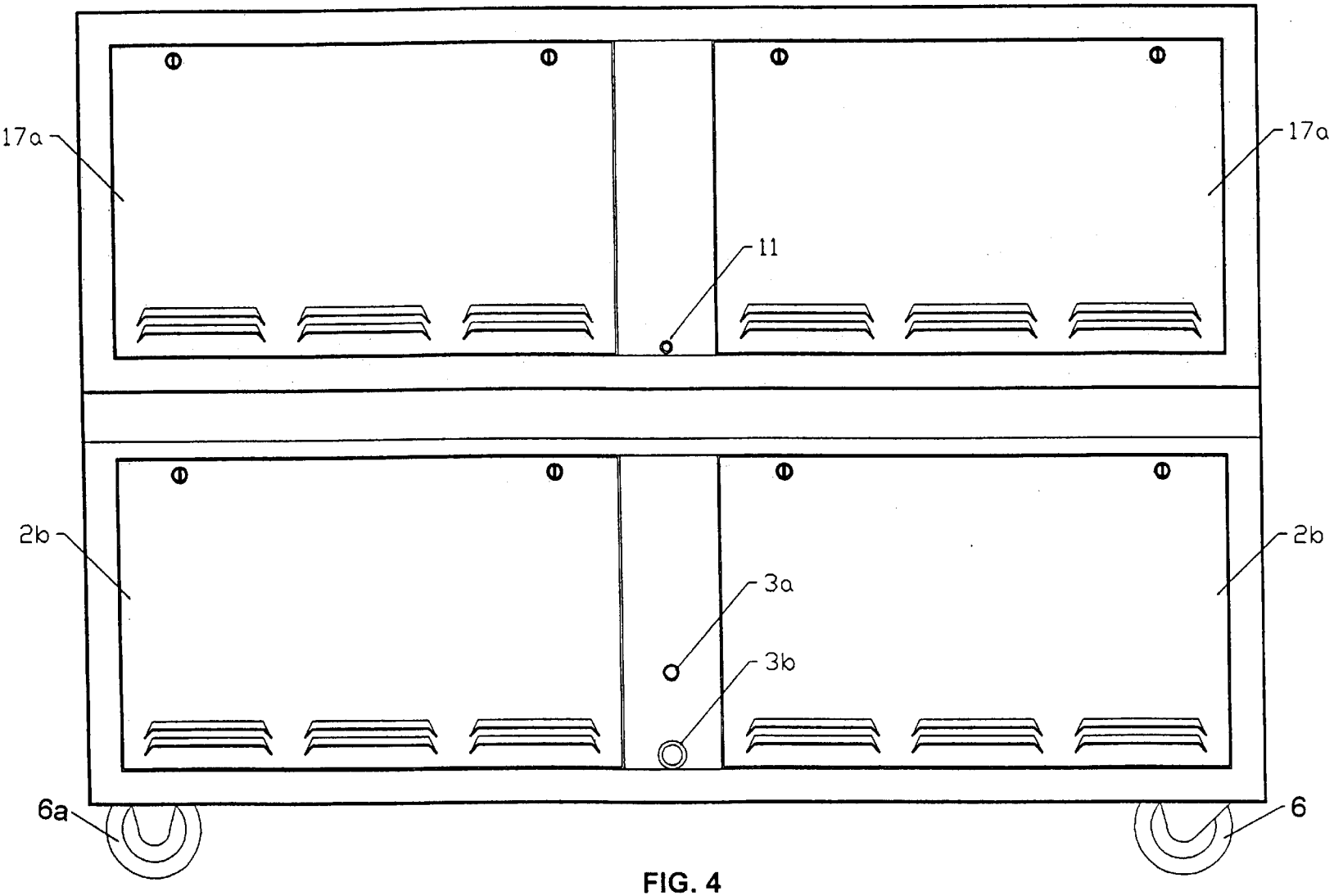
FIG. 4 is a rear view of the preferred embodiment of the apparatus of the present invention.

Doors 2—There are two front doors 2*a* (FIG. 1) and two rear doors 2*b* (FIG. 4). These doors are interchangeable with each other and with the two upper section rear doors 17*a* (FIG. 4). There are two side doors 2*c* (FIG. 3A) and 2*d* (FIG. 3B), one on each side.

Figure 18C:
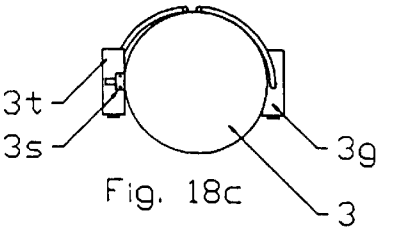
FIG. 18C is a top view of the leveling device of the preferred embodiment of the apparatus of the present invention.
Figure 18A:
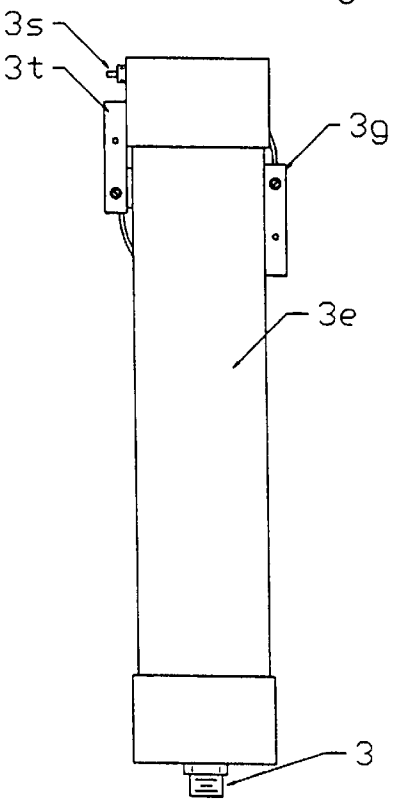
FIG. 18A is a front view of a leveling device of the preferred embodiment of the apparatus of the present invention.
Figure 18B:
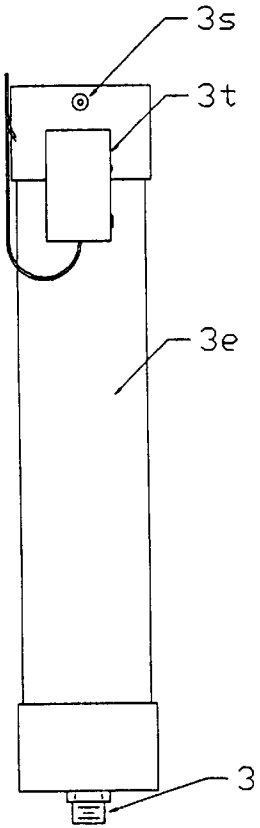
FIG. 18B is a left side view of the leveling device of the preferred embodiment of the apparatus of the present invention.

The plumbing module 3 has an incoming hose connection 3*a* (FIG. 4) for connecting a water hose from the water supply and an outgoing connection 3*b* (FIG. 4) for a drain hose to lead to a drain. The plumbing inlet leads into a pressure regulating valve 3*z* (FIG. 15) with a pressure test port 3*x* and then splits into dual modular sections 3*c* each being controlled by a solenoid-controlled fill valve 3*d*. The purpose of the pressure regulating valve 3*z* is to maintain constant water pressure to the chemical injectors when filling the tanks. Each section feeds two bays 7 (FIG. 2) and a leveling device 3*e* (FIGS. 18A and 18B). Each section feeds directly through chemical injectors 3*f* (FIG. 15) which are connected by tubing from the chemical container 4*a* (FIG. 6B) that sits in the chemical drawer 4. As water flows through the chemical injectors 3*f*, each of the four bays 7 and the leveling devices 3*e* begin to fill with a preset ratio of water and chemical solution (the ratio may vary from location to location depending upon water quality and chemical solution—probably the ratio will be 7–15 cc of chemical solution per liter of water, though more or less may be used). When the leveling devices 3*e* reach their upper limit an electronic detector 3*t* (FIGS. 18A, 18B, 18C) signals the microprocessors (computers) 8/system interface boards 30 which, in turn, signal the solenoid controlled valve 3*d* (FIG. 15) to close. Excess water/chemical solution is discharged through an overflow vent 3*s* (FIGS. 18A, 18B, 18C) on each leveling device 3*e*. As water is used throughout the day, either through evaporation, splashing or just general usage and the level moves below a preset specified level, a second electronic detector 3*g* on the leveling device 3*e* will signal the microprocessor (computer) 8/system interface board 30/system interface board 30 to open the solenoid controlled valve 3*d* (FIG. 15) and allow the bays 7 and the leveling devices 3*e* to fill back to the proper upper level. Each section of the plumbing module has a drain valve 3*h* which is controlled by the microprocessors (computers) 8/system interface boards 30.

Figures 8A, 8B, 8C, 8D:
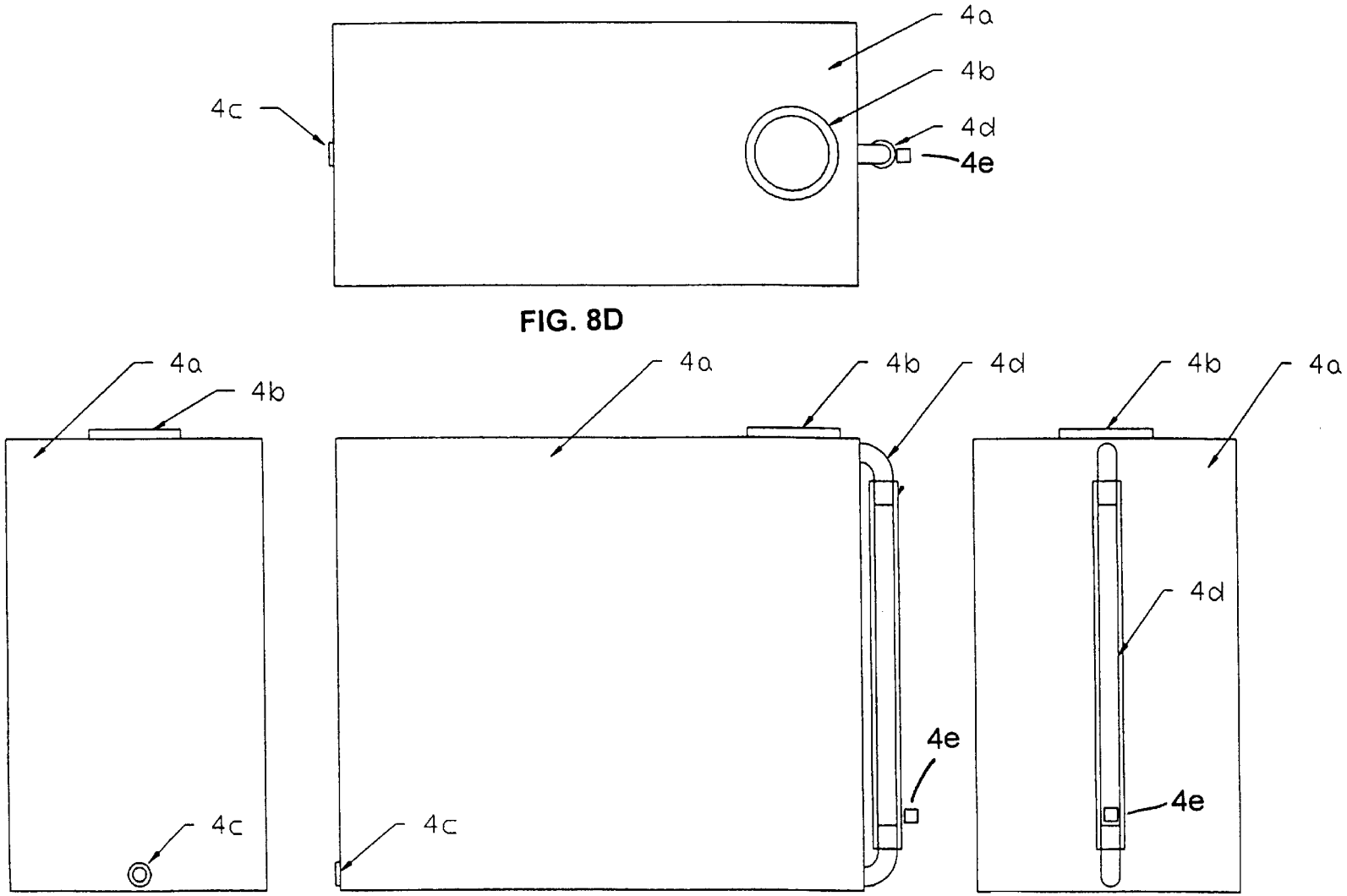
FIG. 8A is a rear view of the chemical container of the preferred embodiment of the apparatus of the present invention.
FIG. 8B is a view of the left side of the chemical container of the preferred embodiment of the apparatus of the present invention (the right side is a mirror image of the left side)
FIG. 8C is a front view of the chemical container of the preferred embodiment of the apparatus of the present invention.
FIG. 8D is a top view of the chemical container of the preferred embodiment of the apparatus of the present invention.
Figure 9A:
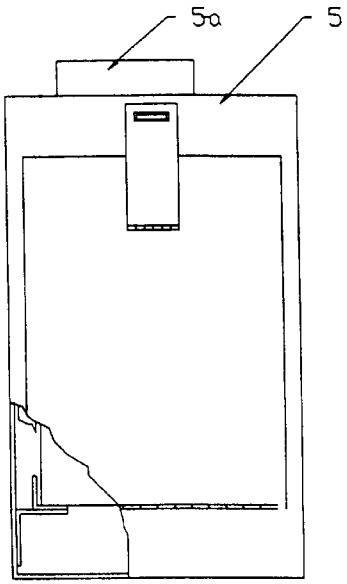
FIG. 9A is a front view of the token box of the preferred embodiment of the apparatus of the present invention.
Figure 9B:
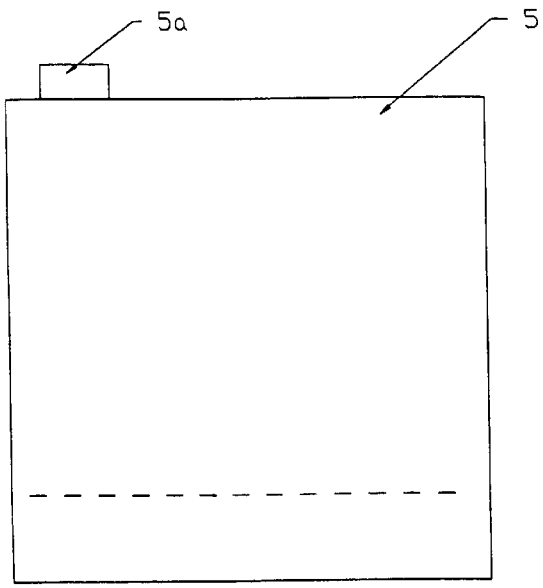
FIG. 9B is a left side view of the token box of the preferred embodiment of the apparatus of the present invention (the right side is a mirror image of the left side)
Figure 9C:
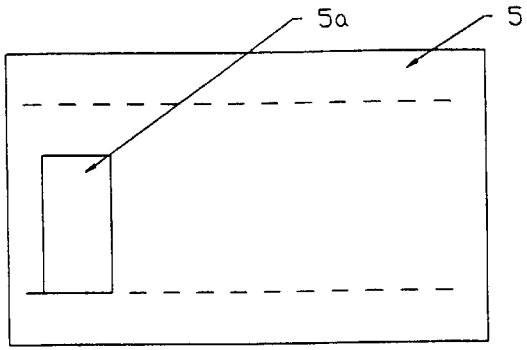
FIG. 9C is a top view of the token box of the preferred embodiment of the apparatus of the present invention.
Figure 10A:
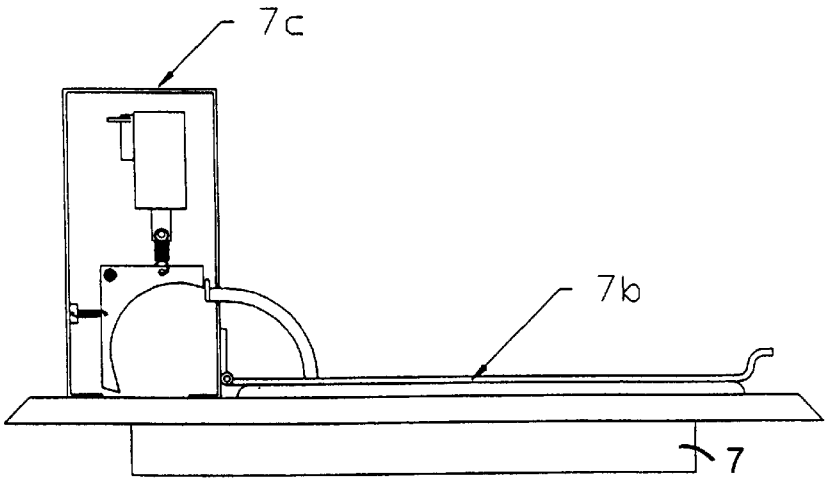
FIG. 10A is a side view of the lid closure device of the preferred embodiment of the apparatus of the present invention, showing the lid in the closed position.
Figure 10B:
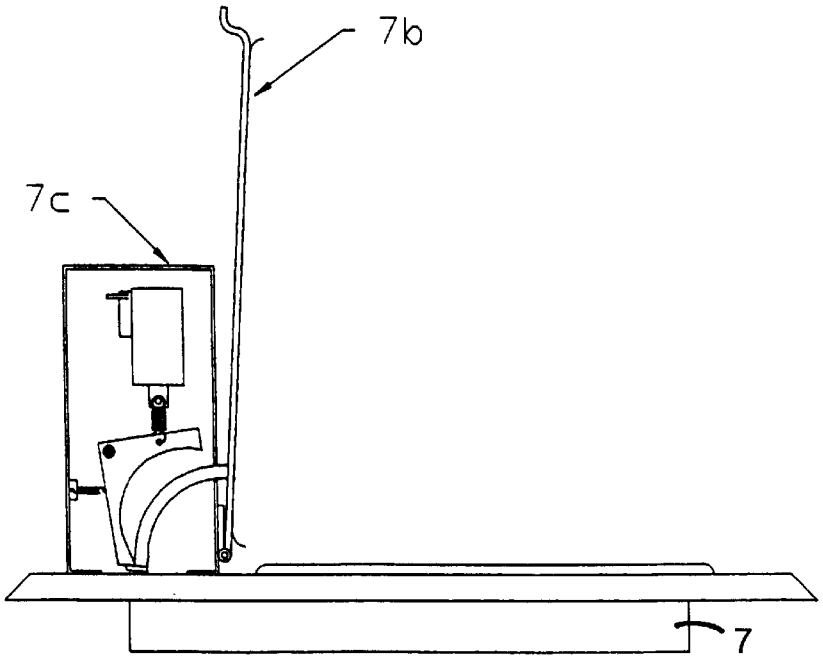
FIG. 10B is a side view of the lid closure device of the preferred embodiment of the apparatus of the present invention, showing the lid in the open position.

The chemical drawer 4 (FIG. 6B) which is on the right side (facing the unit 100 from the front) is behind a door 2*d* (FIG. 3B) on the rear right side of the unit. When this door 2*d* is open, the chemical drawer 4 may be pulled out, allowing the chemical container 4*a* to be opened and filled outside of the unit 100. Two spare one gallon (3.8 liter) chemical containers can fit between the beginning of the drawer 4 and the beginning edge of the chemical container 4*a*. The chemical container 4*a* can hold approximately five gallons (19 liters) of a cleaning chemical for ultrasonic cleaning of golf clubs. The chemical container 4*a* has a fill opening 4*b* in the top, a feed/drain port 4*c* (FIG. 8D) in the bottom of the rear and a sight tube 4*d* in the front. An electronic sensor 4*e* (FIGS. 8B, 8C, and 8D) connected near the bottom of the sight tube signals the microprocessors (computers) 8/system interface boards 30 when there is an insufficient amount of chemical in the chemical container 4*a*. The electronic sensor 4*e* can be the same type of sensor as electronic detector 3*t* (FIGS. 18A, 18B, 18C).

Figure 5:
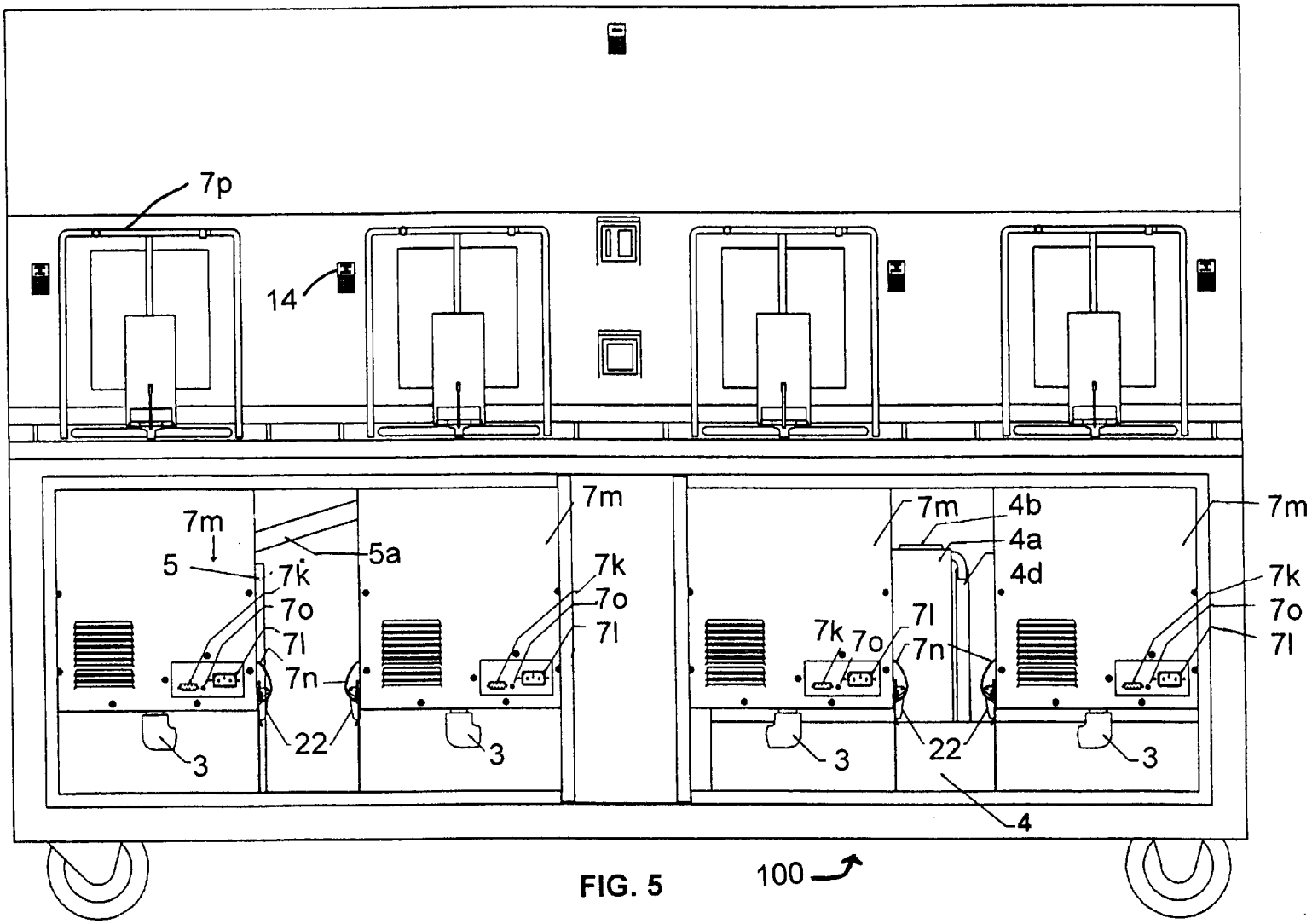
FIG. 5 is a front view of the preferred embodiment of the apparatus of the present invention with the front doors removed.

The token box 5 (FIG. 5) is on the left side (facing the unit 100 from the front) behind the door 2*c* to the rear of the left side. The token box 5 has its own separate lock. This allows only the golf facility and CLEAN CLUBS CORPORATION access to opening the token box 5. The token box 5 is fed by a chute 5*a* directly from the token slot/taker 9 into the top of the token box 5.

There are four wheels on this unit, two swiveling 6 (FIG. 1) and two stationary 6*a* that will allow the unit to be pushed or towed into place to operate and/or into storage.

Figure 11B:
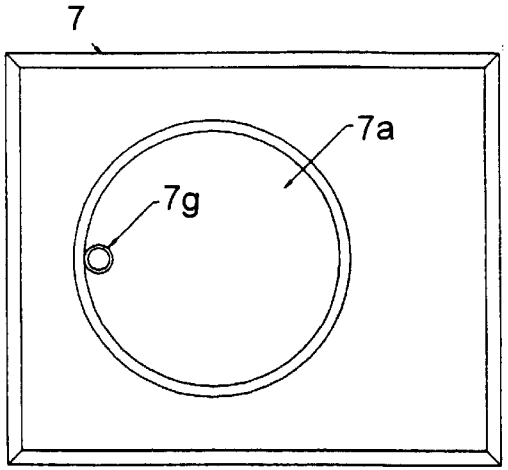
FIG. 11B is a top view of the modular bay of the preferred embodiment of the apparatus of the present invention.
Figure 11C:
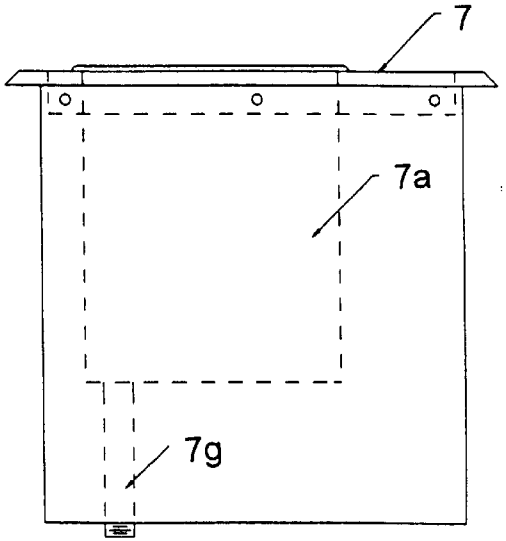
FIG. 11C is a side view of the modular bay of the preferred embodiment of the apparatus of the present invention.
Figure 11A:
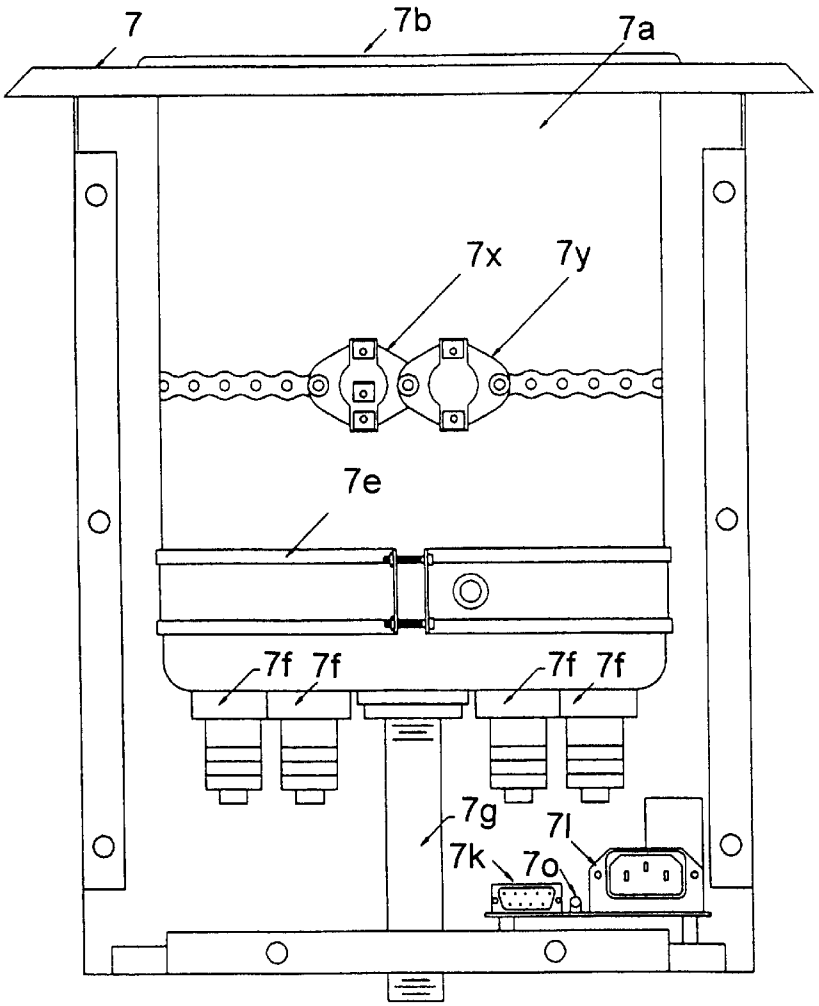
FIG. 11A is a front view of the modular bay of the preferred embodiment of the apparatus of the present invention.
Figure 17B:
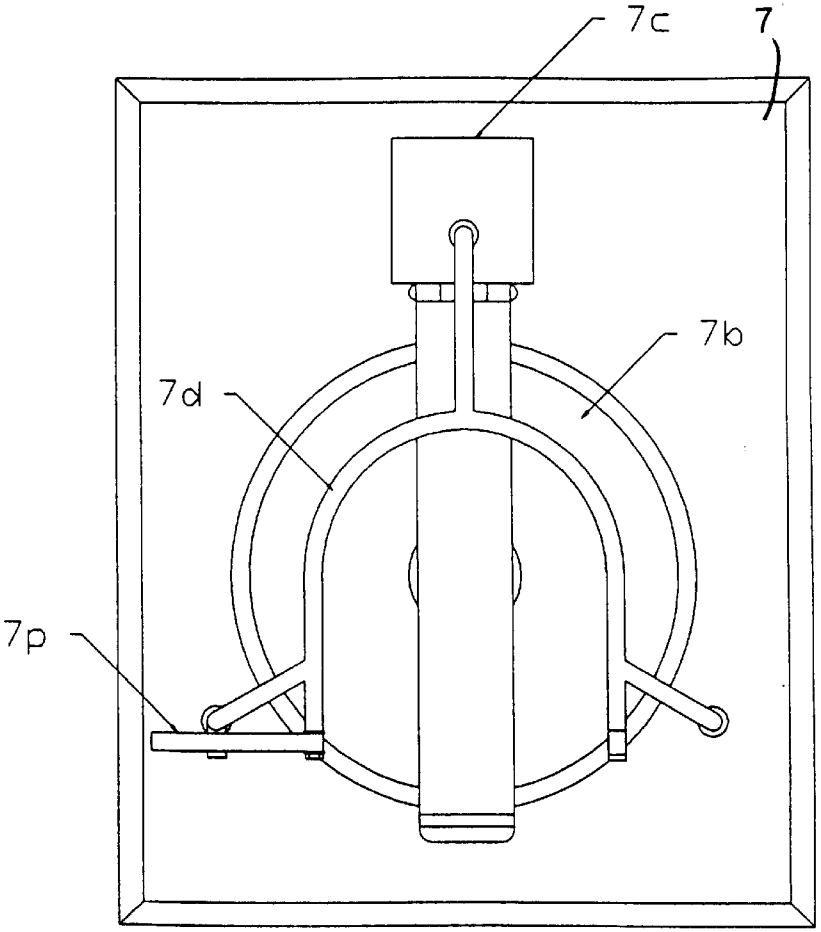
FIG. 17B is a top view of a bracket of the preferred embodiment of the apparatus of the present invention.
Figure 17A:
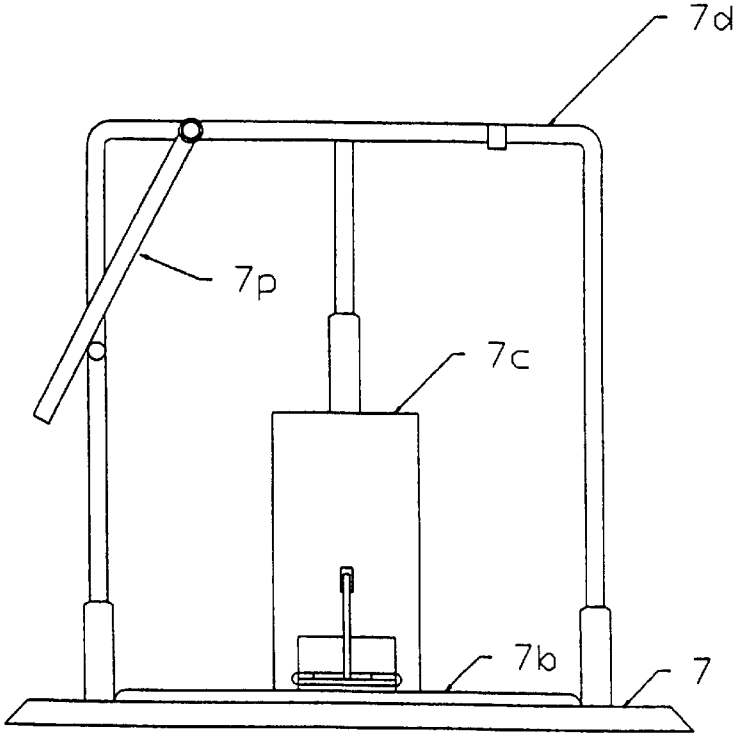
FIG. 17A is a front view of a bracket of the preferred embodiment of the apparatus of the present invention.

Each modular bay 7 consists of the following: a stainless steel tank 7*a* (FIGS. 11A, 11B, 11C; a lid 7*b* (FIG. 11A) for the stainless steel tank 7*a*; a lid device 7*c* (FIGS. 17A and 17B) which is controlled by the microprocessor (computer) 8/system interface board 30 to keep the lid 7*b* in the closed position until a token has been put into the machine 100 and that particular bay 7 has been signaled to operate. At that point in time, the lid 7*b* may be opened by the user and will be held in the open position until the cleaning cycle has finished and the golfer has removed all of the clubs.

A bracket 7*d* (FIGS. 1, 17A, 17B) above the bay 7 enables the golfer to place the opposite ends of the clubs from those that are being cleaned inside the bracket 7*d* to keep them from falling or leaning into the other areas where other bays 7 are operating and/or into the face of the golfer using that bay 7. A bracket 7*d* has a section 7*p* (FIGS. 1, 17A, 17B) in the front of the bracket 7*d* that the golfer swivels out of the way to allow easy access to the bay 7 for the placing or removing of clubs. This section 7*p* is swiveled into the closed position, prior to cleaning, to insure that all clubs stay within the bracket during cleaning.

A heater band 7*e* (FIG. 11A) around the bottom portion of the tank 7*a* is a means to heat the water/chemical solution in the tank 7*a*. There is a temperature sensor 7*x* on each bay 7. The temperature sensor 7*x* signals the microprocessor (computer) 8/system interface board 30/system interface board 30 when the minimum operating temperature level of the water/chemical solution in the bay 7 has been reached. The temperature sensor 7*x* also signals the microprocessor (computer) 8/system interface board 30 when the maximum operating temperature of the water/chemical solution in the bay 7 has been reached. There is also a fail/safe cut out 7*y* on each bay 7 which will shut off the heater bands 7*e* when the maximum temperature has been reached and the maximum temperature sensor 7*x* fails.

A transducer array consisting of 8 to 9 transducers 7*f* positioned around the bottom of the tank 7*a* to create the ultrasonic energy.

An isolation valve 7*g* enables a bay 7 to be serviced at any time even while the other bays 7 are operating.

Figure 12A:
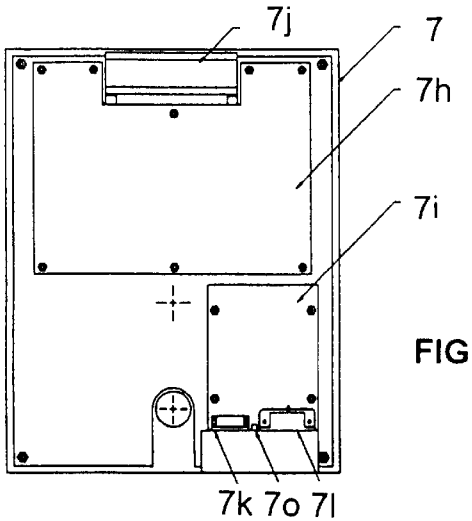
FIG. 12A is a top view of the bay of the preferred embodiment of the apparatus of the present invention, with the tank removed.
Figure 12B:
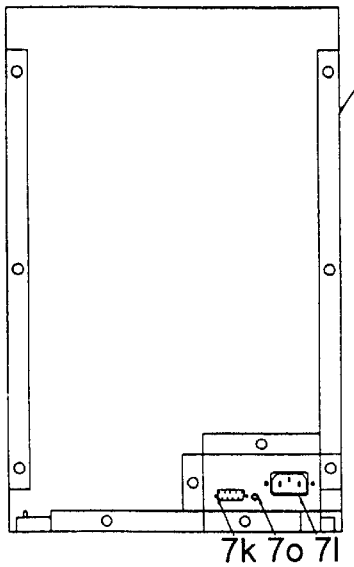
FIG. 12B is a front view of the bay of the preferred embodiment of the apparatus of the present invention.
Figure 12C:
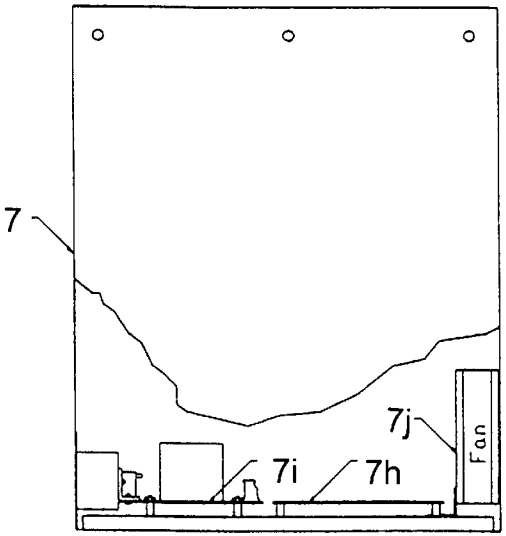
FIG. 12C is a side, partially cut-away view of the bay of the preferred embodiment of the apparatus of the present invention.
Figure 13:
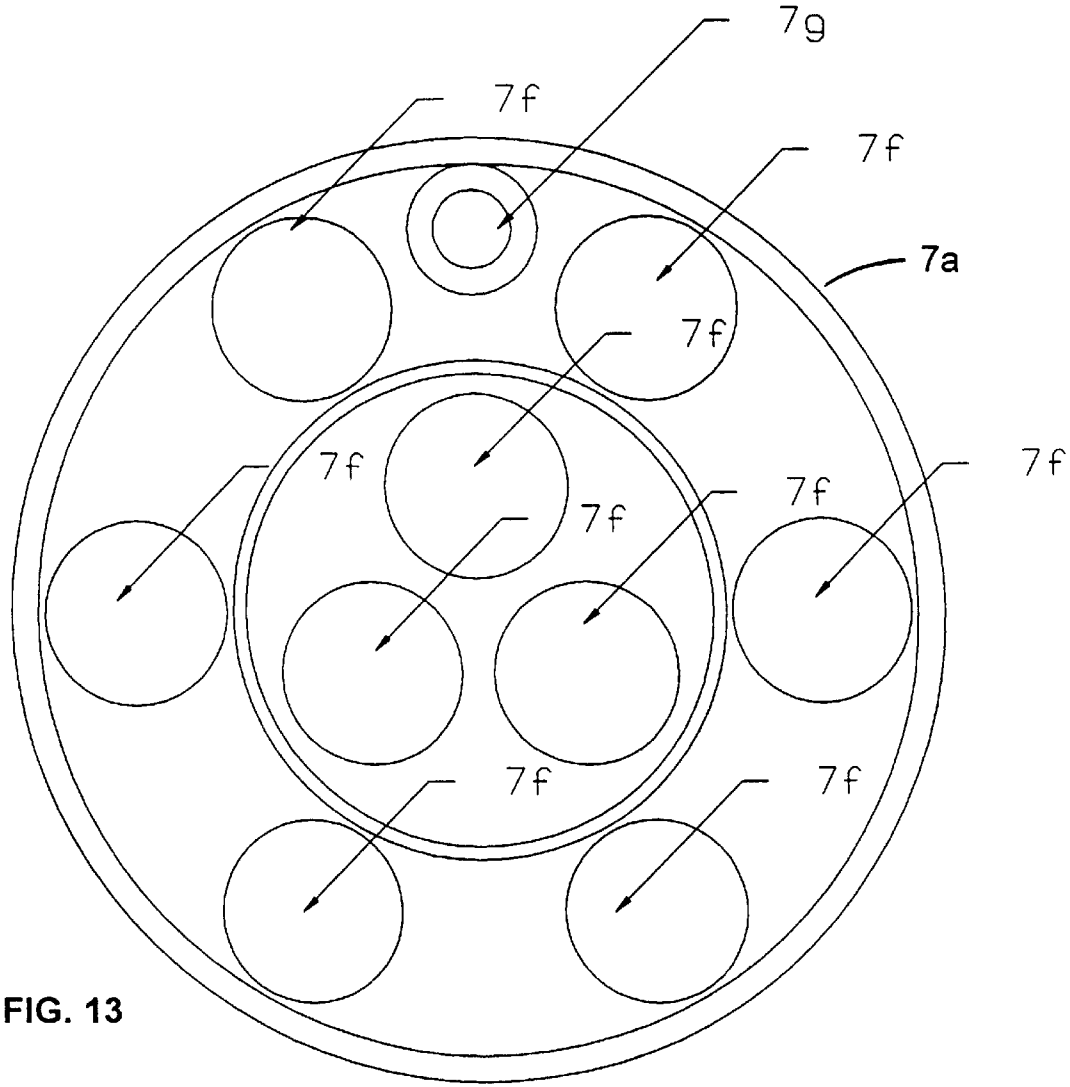
FIG. 13 is a bottom view of the tank of an alternative embodiment of the apparatus of the present invention.
Figure 14:
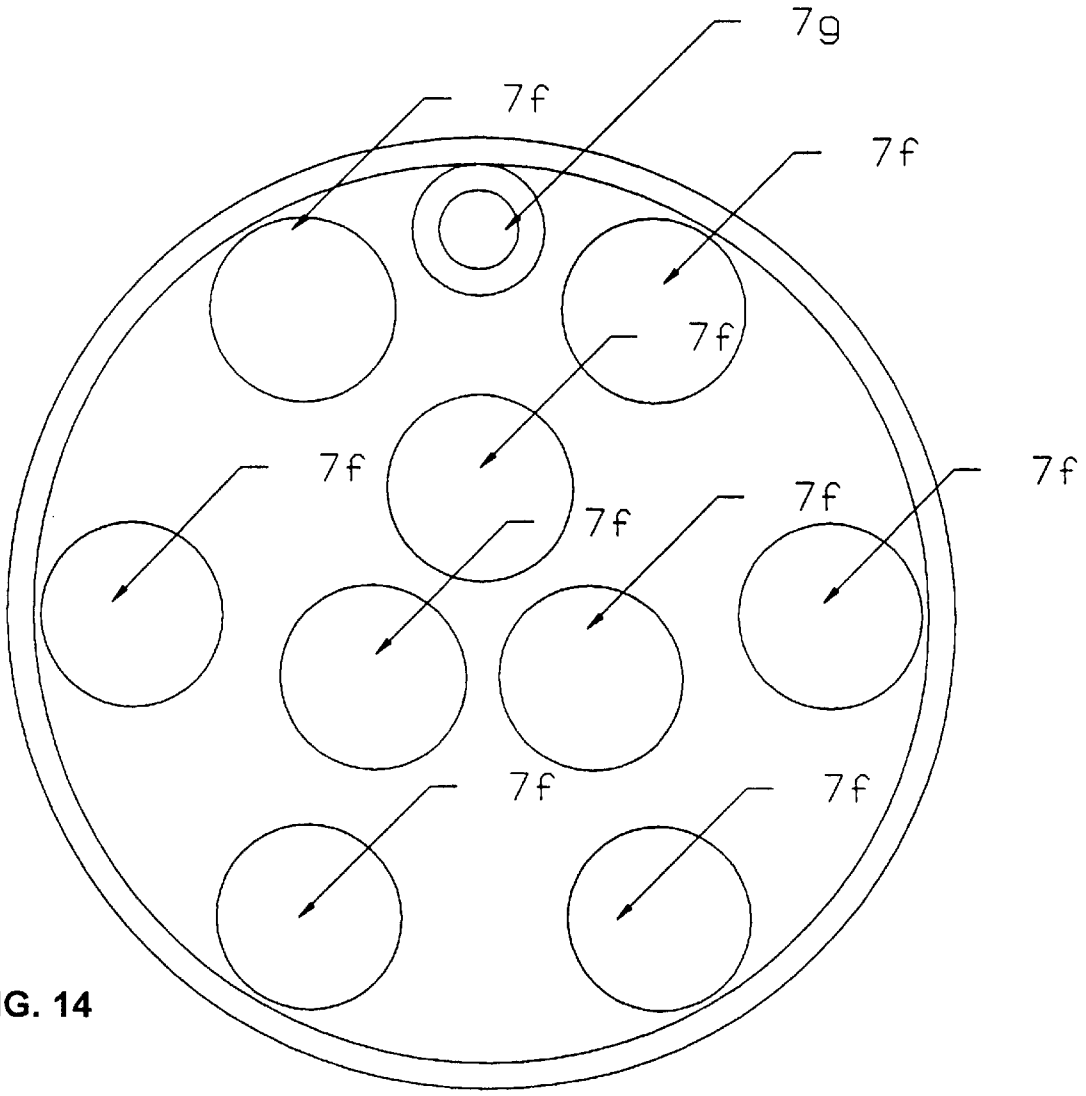
FIG. 14 is a bottom view of the tank of the preferred embodiment of the apparatus of the present invention.

The modular interface board 7*i* (FIGS. 12A, 12C) connects the bay 7 to electrical power and the microprocessor (computer) 8/system interface board 30 and controls the heater strip 7*e*, the cooling fan 7*j* (FIG. 12A) and the electronic circuit driver board 7*h* (FIG. 12C) which drives the transducer array 7*f*. The cooling fan 7*j* to keep all of the electronics from overheating. A (computer) cable 7*k* (FIGS. 12A, 12B) leads from the bay 7 to the system interface board 30 that with the microprocessor (computer) 8 controls that bay 7.

A power cord 7*l* leads to a dedicated GFI protected power source 12 for that particular bay 7.

Figure 15:
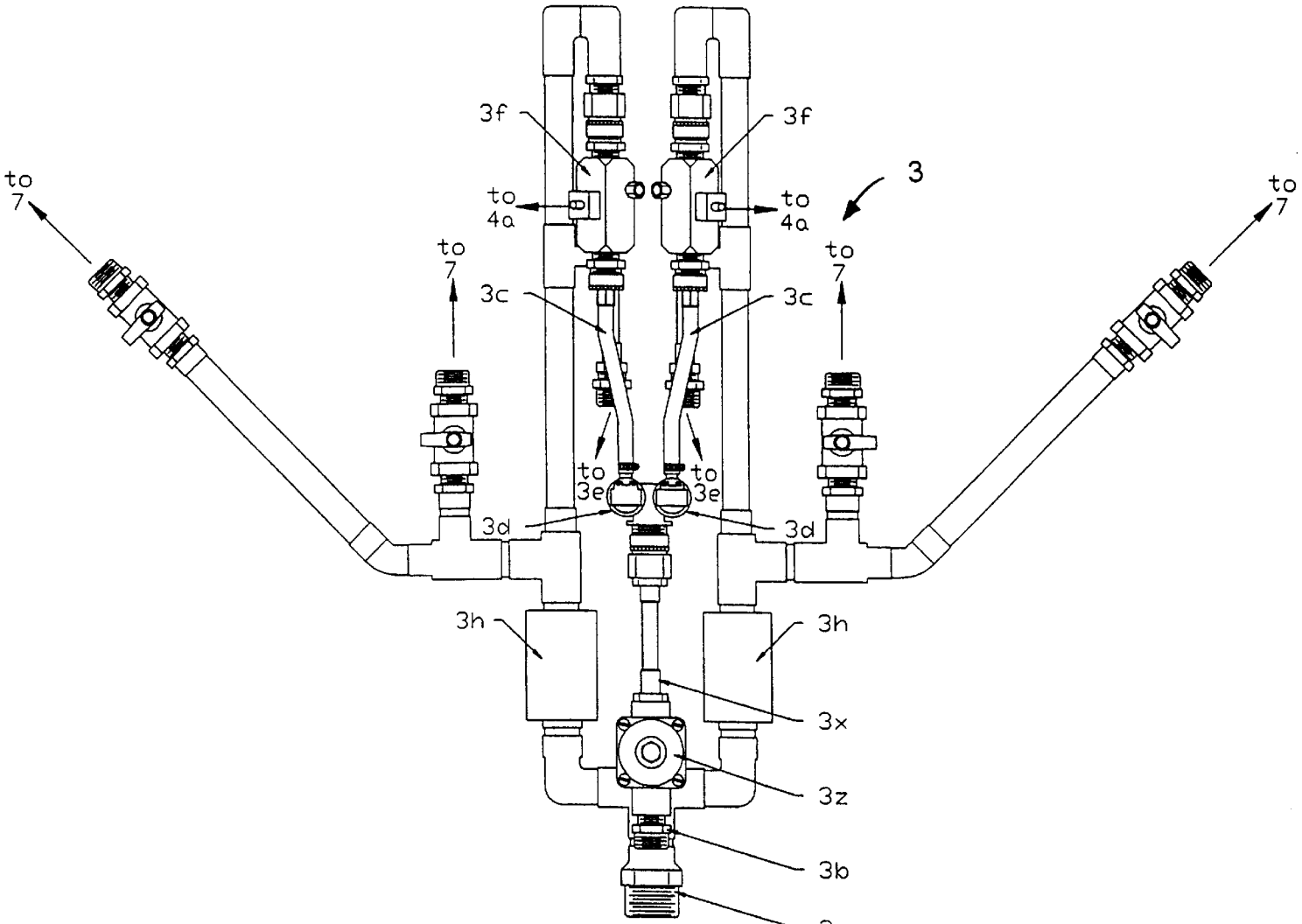
FIG. 15 is a top view of the plumbing module of the preferred embodiment of the apparatus of the present invention.
Figure 16B:
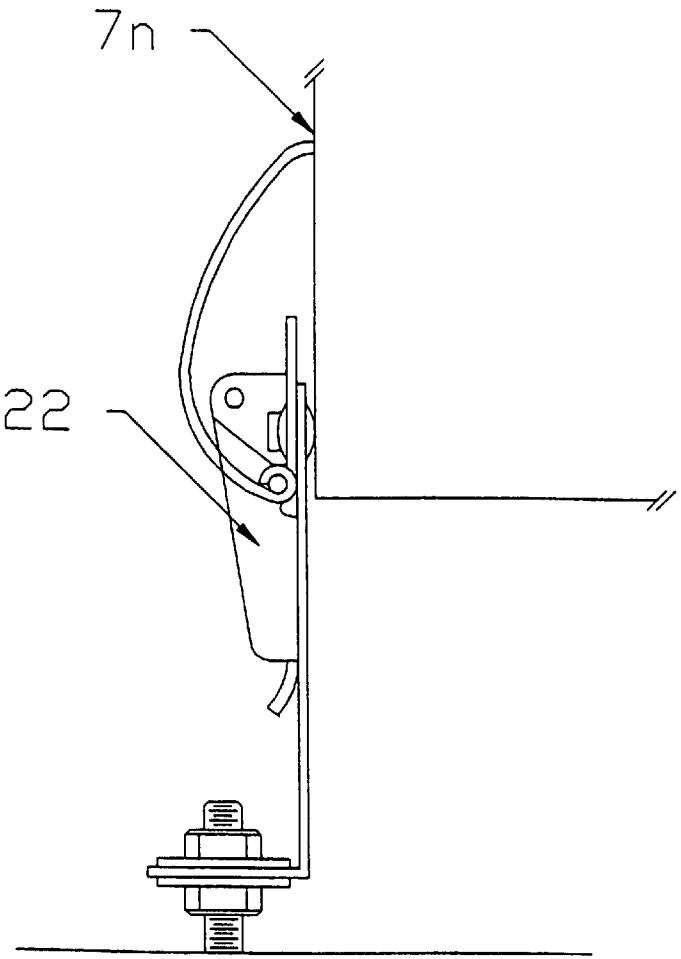
FIG. 16B is a side view of a hold-down device of the preferred embodiment of the apparatus of the present invention.
Figure 16A:
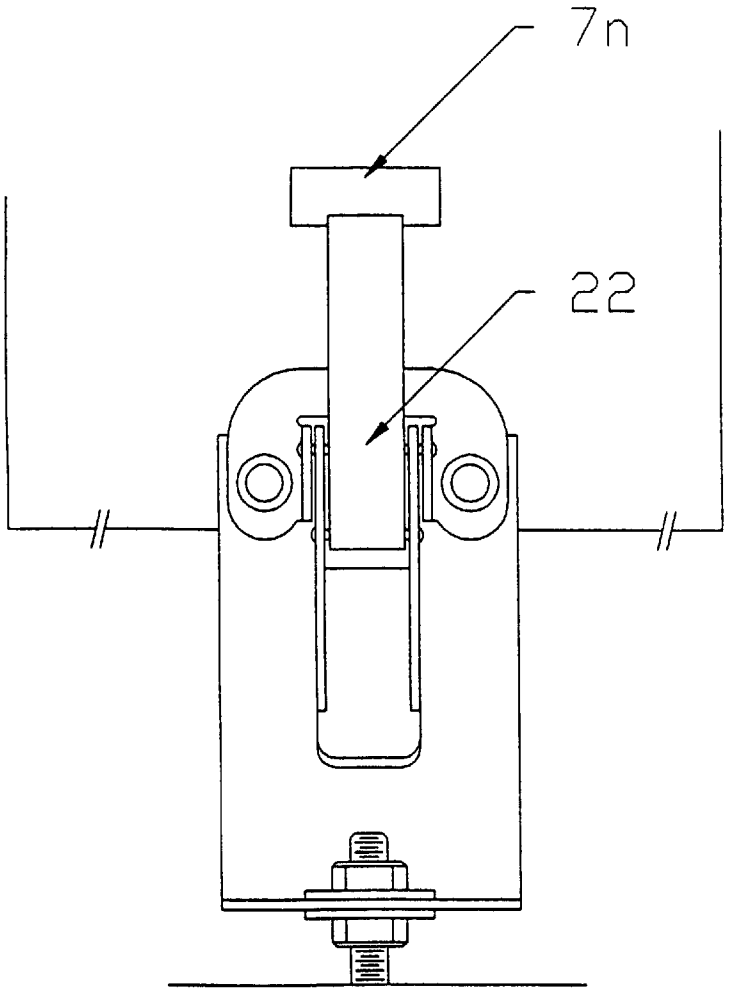
FIG. 16A is a front view of a hold-down device of the preferred embodiment of the apparatus of the present invention.

A cabinet 7*m* (FIG. 5) encloses the entire bay from the top of the tank 7*a* down to the piping 7*g* that connects to the plumbing module 3 (FIG. 15).

Each cabinet 7*m* has hooks 7*n* on either side of the cabinet 7*m* providing for the entire bay 7 to be held down in place inside of the unit by hold down devices 22.

Each cabinet has a red light 7*o* (FIGS. 12A, 12B) on the front which when "on" indicates that this bay 7 has a problem, is not available for use, and service should be called.

Each modular bay 7 can be removed from the unit 100 (even during operation of the unit) by disconnecting the power cord 7*l*, the (computer) cable 7*k*, draining the water from that particular bay 7, disconnecting the plumbing module 3 from that particular bay 7, and releasing the hold down devices 22 from the hooks 7*n* on the cabinet 7*m*.

II. Upper Section

There are two system interface boards 30, one a master and one a slave. The two system interface boards 30 work with the two microprocessor (computers) 8 to control the entire operation of the unit.

There are two redundant microprocessors (computers) 8/system interface boards 30 that will control the operations of the four modular bays 7. Each microprocessor (computer) 8/system interface board 30 is responsible for controlling two bays 7 but will work redundantly in controlling the other operations of the unit.

The preprogrammed Token Slot/Token Taker 9/Token Return Slot 10 setup is electronically controlled by the microprocessors (computers) 8/system interface boards 30 to reject tokens if the unit 100 is not in operation and READY. These tokens will be returned at the Token Return Slot 10 directly below the Token Slot/Token Taker 9 which is independently preprogrammed to accept only tokens that meet specific requirements relating to diameter, thickness and weight. All tokens that are accepted by the Token Slot/Token Taker 9 will automatically flow into the token box 5 in the lower section of the unit.

The unit 100 operates on 120 volts and all incoming power is fed into GFI outlets 12 into which all electrical components are connected. The electrical power connection 11 feeds the GFI receptacles 12 which feed the 6 amp circuit breaker 11*a* which in turn feeds the power supply terminal block 11*b*, the 24 vac power supply 11*c* and the 24 vdc power supply 11*d*.

The READY light 13 is in the center at the top front portion of the unit where the Sign 19 is located. This READY light 13 is on when any bay 7 within the unit is ready to be used and off when no bays 7 are ready or all bays 7 are in use and/or unavailable.

There is a Light button illuminated push button 14 above each of the modular bays 7. These light buttons illuminated push buttons 14 indicate to a golfer in which bay a golfer is no place his or her clubs that are to be cleaned.

The unit 100 is equipped with a modem 15 for the purpose of having a dedicated phone line connected directly to this unit for querying and troubleshooting.

The unit is equipped with a chime 21 (FIG. 7) for the purpose of sounding to alert the golfers that the unit is ready to use, a bay 7 is ready for use, a bay 7 has paused cleaning and/or a bay 7 has finished cleaning.

Cooling fans (not shown) are placed in the unit 100 to cool all of the electronics in the upper section of the unit.

The two doors 17*a* (FIG. 4) on the rear of this upper section are the same size as and are interchangeable with the four doors 2*a* (FIG. 1) and 2*b* (FIG. 4) that are on both the front and rear of the lower section of the unit. There is one small door 17*b* (FIG. 3B) near the bottom of the right side facing the unit from the front of this upper section. Behind this door is a lighted switch 17*c* (FIG. 6B) that allows manual signaling to the microprocessors (computers) 8/system interface boards 30 to begin filling and/or draining the unit 100. This lighted switch 17*c* also will flash indicating a failure. This lighted switch 17*c* allows the microprocessors (computers) 8/system interface boards 30 to be reset and enable a bay 7 that was out of service due to a failure but that is now ready to be back in service.

Next to each light button illuminated push button 14 above each modular bay 7 are Instructions/Warning Information 18 (FIG. 1) which includes specific instructions on how to use the unit as well as any necessary and/or required warnings.

At the top front portion of the upper section is a sign 19 approximately 72 inches (1.83 m)×12 inches (30 cm). This sign states what the unit is and for what it is to be used.

There is an attachment 20 that goes on the top of the unit. This is utilized for advertising purposes. It can be approximately 72 inches (1.83 m) in length and up to approximately 36 inches (91 cm) in height, for example.

Exemplary Dimensions of the Multi-Bay, Dual Microprocessor (Computer) Controlled Ultrasonic Golf Club Cleaner of the Present Invention The Complete Unit Height—48 inches (1.22 m) (The advertising section 20 will add 24 inches (61 cm) to 36 inches (91 cm) to the height)

Length—72 inches (1.83 m)

Depth—33 inches (84 cm)

The wheels 6 and 6*a* will add 2 inches to 6 inches (5 cm to 15 cm) in height.

The Lower Section A

Height—25 inches (63 cm) (This section is 25 inches (63 cm) high in the rear and 23 inches (58 cm) high in the front).

Length—72 inches (1.83 m)

Depth—33 inches (84 cm)

The wheels 6 and 6*a* will add 2 inches to 6 inches (5 cm to 15 cm) in height.

Doors 2

The front 2*a* and rear 2*b* doors are 31 inches (79 cm) long by 19 inches (48 cm) high.

The side doors 2*c* and 2*d* are 10 inches (25 cm) long by 15⅝ inches (40 cm) high.

The Deck 1

(This is actually the top portion of the lower section A and is where the 4 modular bays 7 are located.)

The rear section of deck 1 is 3 inches (8 cm) high by 72 (1.83 cm) long by 11 inches (28 cm) deep. The upper section B is attached to the lower section A at this point.

The front section of deck 1 is 22 inches (56 cm) deep by 72 inches (1.83 m) long and slopes forward from a height of 2 inches (5 cm) to a height of 1 inch (2.5 cm).

The modular bays 7 are set 1.5 inches (4 cm) in from the each of sides of the deck 1 and 0.5 (1.3 cm) from the front of the deck 1.

The modular bays 7 are 4 inches (10 cm) apart between the 1st and 2nd bays 7 and between the 3rd and 4th bays 7 and 5 inches (13 cm) apart between the second and third bays 7.

The deck 1 is actually a one-piece unit but is described in two sections for ease of description and dimension.

Chemical Container 4*a*

Height—12 inches (30 cm)

Length—14 inches (36 cm)

Depth—7 inches (18 cm)

The fill opening 4*b* is 2 inches (5 cm) in diameter.

The feed/drain port 4*c* is ⅜ inch (1 cm) in diameter.

The sight tube is ½ inch (1.3 cm) in diameter.

Token Box 5

Height—14 inches (36 cm)

Length—14 inches (36 cm)

Depth—8½ inches (22 cm)

Modular Bays 7

Height—18.5 inches (47 cm)

Length—12 inches (30 cm)

Depth—15 inches (38 cm)

The Tank 7*a*

The tank 7*a* is a round unit with a 9 inches to 10 inches (23 cm to 25 cm) diameter and a depth of 11 inches (28 cm)

The Bracket 7*d*

The bracket 7*d* is 13 inches (33 cm) in height, 6 inches to 7 inches wide (15 cm to 18 cm) and 7 inches to 9 inches (18 cm to 23 cm) deep.

The Lid Device 7*c*

The lid device 7*c* is 6 inches (15 cm) high by 3 inches (8 cm) long by 3 inches (8 cm) deep.

The Upper Section B

Height—23 inches (58 cm)

Length—72 inches (183 cm)

Depth—11 inches (28 cm) at the base of the upper section up to a height of 11 inches (28 cm) and then tapering back to a depth of 7 inches (18 cm) at the top of the upper section.

Doors 17

The rear doors 17*a* are 31 inches (79 cm) long by 19 inches (48 cm) high.

The side door 17*b* is 5 inches (13 cm) long by 8 inches (20 cm) high.

Tables of suitable parts to make the present invention follow.

ASSEMBLY: (3)Plumbing Module + PN

| Name | Reference # | Description | Manufacturer | Manuf. Part # | Supplier |
|---|---|---|---|---|---|
| PRV1 | 3z | Pressure Reducing Valve | Watts Regulating co. | N250B Model A | |
| SOL 1&2 | 3d | Dual Solinoid Valve Assembly | Kema Keur | Type 349 | |
| Dema 1 | 3f | Dema Soap Injecting Valve | Dema | Model 206B | |
| Dema 2 | 3f | Dema Soap Injecting Valve | Dema | Model 206B | |
| LD 1&2 | 3e | Leveling Tank Assembly (T1 & T2) | AMS | N/A | AMS |
| S1 | 3g | Low Level Sensor T1 | Carlo Gavazzi | ACF10PPO | Carlo Gavazzi |
| S2 | 3t | High Level Sensor T1 | Carlo Gavazzi | ACF10PPO | Carlo Gavazzi |
| S3 | 3g | Low Level Sensor T2 | Carlo Gavazzi | ACF10PPO | Carlo Gavazzi |
| S4 | 3t | High Level Sensor T2 | Carlo Gavazzi | ACF10PPO | Carlo Gavazzi |
| DR1 | 3h | Drain Valve 1 | Honeywell | V8043C1066 | |
| DR2 | 3h | Drain Valve 2 | Honeywell | V8043C1066 | |
| ST | 4a | Soap Tank | Norsteel | C3NPM1 | Norsteel |
| S5 | 4e | Low Level Sensor Soap | Carlo Gavazzi | ACF10PPO | Carlo Gavazzi |
| TSB | 5 | Token Strong Box | Norsteel | C3NPM2 | Norsteel |

ASSEMBLY: Control Panel Master PN

| Name | Reference # | Description | Manufacturer | Manuf. Part # | Supplier |
|---|---|---|---|---|---|
| PANEL | | Main Panel Back-plate | Norsteel | C3NCPM1 | Norsteel |
| CB1 | | Main Panel Circuit Breaker 6 Amp | Klockner Moeller | FAZN B6 | Klockner Moeller |
| PCB1 | 11a | System Interface Board | AMS | 01.333.200.002 | AMS |
| PLC1 | 30 | PLC Assembly | Klockner Moeller | PS4-141-MMI-EE | Klockner Moeller |
| RBI-1 | | Ribbon Interface Input | AMS | 01.333.200.005/I | AMS |
| RBI-2 | | Ribbon Interface Input | AMS | 01.333.200.005/I | AMS |
| RBO-1 | | Ribbon Interface Output | AMS | 01.333.200.005/O | AMS |
| RBO-1 | | Ribbon Interface Output | AMS | 01.333.200.005/O | AMS |
| PS1 | 11d | 24 vdc Power Supply Regulated | Omron | S82K-05024 | Electrosonic |
| PS2 | 11c | 24 vac Power Supply 50 va | Hammond | PH50JG | Electrosonic |
| J1 | | Ribbon 20 conductor 1 × 20 pin to 2 × 10 pin | AMS | 00.333.200.006 | AMS |
| J2 | | Ribbon 20 conductor 1 × 20 pin to 2 × 10 pin | AMS | 00.333.200.006 | AMS |
| J3 | | Ribbon 20 conductor 1 × 20 pin to 1 × 20 pin | AMS | 00.333.200.007 | AMS |

-continued

ASSEMBLY: Control Panel Master
PN

| Name | Reference # | Description | Manufacturer | Manuf. Part # | Supplier |
|---|---|---|---|---|---|
| J4 | | Ribbon 10 conductor 1 × 10 pin to 1 × 10 pin | AMS | 00.333.200.008 | AMS |
| GFI-1 | 12 | GFI Protected Duplex Receptacle Panel | N/A | N/A | Home Depot |
| GFI-2 | 12 | GFI Protected Duplex Receptacle Module 1 | N/A | N/A | Home Depot |
| GFI-3 | 12 | GFI Protected Duplex Receptacle Module 2 | N/A | N/A | Home Depot |
| CBL-1 | 7k | DB9 Cable M-F 6' Long Module 1 | N/A | N/A | Saynor |
| CBL-2 | 7k | DB9 Cable M-F 6' Long Module 2 | N/A | N/A | Saynor |
| PCD-1 | 71 | Power Cord Chasis Style Module 1 | Belden | 17251B | Electrosonic |
| PCD-2 | 71 | Power Cord Chassis Style Module 2 | Belden | 17251B | Electrosonic |
| TR1 | | Track Curtis Mounting 1' | Curtis | TR2 | Electrosonic |
| TR2 | | Track DIN Rail Mounting 1' | Wieland | 98.300.0000.0 | Wieland |
| DCT | | Duct Electro .95 × 1.89 | Wieland | 50025 | Wieland |
| Modem | 15 | Remote Communication Modem | US-Robotics | Sporster 28.8 | Paramount Comp. |
| TR | 9 | Token Reader | Mars Electronics Int. | Cashflow 330 | Mars Electronics Int. |

ASSEMBLY: (7i)Module Interface Board
PN 01.333.200.002

| Name | Reference # | Description | Manufacturer | Manuf. Part # | Supplier |
|---|---|---|---|---|---|
| PCB | | Printed Circuit Board Blank | Apollo Circuits | 00.333.200.002 | Apollo Circuits |
| C1 | | Capacitor Electrolytic 10 uF/63 v Radial | Philips | 037-38109 | Electrosonic/Sayal |
| C2 | | Capacitor Electrolytic .1 uF | Philips | CK-104 | Electrosonic/Sayal |
| C3 | | Capacitor Electrolytic 47 uF/63 v Radial | Philips | 037-38479 | Electrosonic/Sayal |
| C4 | | Capacitor Electrolytic 100 uF/25 v Radial | Philips | 037-38101 | Electrosonic/Sayal |
| CB1 (or F1) | | Circuit Breaker 6 Amp | | | |
| F1 or (CB1) | | Fuse 10 Amp Slo-blow | | | |
| FC1 or (CB1) | | Fuse Clip End | Keystone | 3514 | Electrosonic |
| FC2 or (CB1) | | Fuse Clip End | Keystone | 3514 | Electrosonic |
| CR1 | | LED Green | Lite-On | LTL-4232N | Electrosonic/Sayal |
| CR2 | | LED Green | Lite-On | LTL-4232N | Electrosonic/Sayal |
| CR3 | | LED Green | Lite-On | LTL-4232N | Electrosonic/Sayal |
| CR4 | | LED Green | Lite-On | LTL-4232N | Electrosonic/Sayal |
| CR5 | | LED Red | I.D.I. LEDs | 5380E1 | Electrosonic/Sayal |
| CR6 | | Diode 1N914 | Nat'l Semiconductor | 1N914 | Electrosonic/Sayal |
| CR7 | | Diode 1N914 | Nat'l Semiconductor | 1N914 | Electrosonic/Sayal |
| CR8 | | Diode 1N914 | Nat'l Semiconductor | 1N914 | Electrosonic/Sayal |
| CS1 | | Current Switch | Carlo Gavazzi | EISSNNOA20A | Carlo Gavazzi |
| D1 | | Diode 1N914 | Nat'l Semiconductor | 1N914 | Electrosonic/Sayal |
| D2 | | Diode 1N914 | Nat'l Semiconductor | 1N914 | Electronic/Sayal |
| K1 | | Relay 24 vdc | Carlo Gavazzi | MZPA0024810 | Carlo Gavazzi |
| K2 | | Relay 24 vdc | Carlo Gavazzi | MZPA0024810 | Carlo Gavazzi |
| K3 | | Relay 24 vdc | Carlo Gavazzi | MZPA0024810 | Carlo Gavazzi |
| K4 | | Relay 120 vac | Carlo Gavazzi | MZPA0029510 | Carlo Gavazzi |
| KB1 | | Relay Base | Carlo Gavazzi | ZH9 | Carlo Gavazzi |
| KB2 | | Relay Base | Carlo Gavazzi | ZH9 | Carlo Gavazzi |
| KB3 | | Relay Base | Carlo Gavazzi | ZH9 | Carlo Gavazzi |
| KB4 | | Relay Base | Carlo Gavazzi | ZH9 | Carlo Gavazzi |
| MOV 1 | | Metal Oxide Varistor 150 vac | Siemens | S07K150 | Electrosonic/Sayal |
| MOV 2 | | Metal Oxide Varistor 150 vac | Siemens | S07K150 | Electrosonic/Sayal |
| MOV 3 | | Metal Oxide Varistor 150 vac | Siemens | S07K150 | Electrosonic/Sayal |
| MOV 4 | | Metal Oxide Varistor 35 vac | Siemens | S07K35 | Electrosonic/Sayal |
| P1 | | Plug DB9 | AMP | 748879-2 | Electrosonic/Sayal |
| P2 | | Plug AC Power | AMP | 22-18 110 | Electrosonic/Sayal |
| P3 | | Potentiometer 10 Turn 500 K ohm | Bourns | 3296W-1-504 | Electrosonic/Sayal |
| Q1 | | Transistor NPN 2N2222 | | 2N2222 | Electrosonic/Sayal |
| R1 | | Resistor 220 ohm | Philips | CR25 | Electrosonic/Sayal |
| R2 | | Resistor 220 ohm | Philips | CR25 | Electrosonic/Sayal |
| R3 | | Resistor 220 ohm | Philips | CR25 | Electrosonic/Sayal |
| R4 | | Resistor 2.2K ohm | Philips | CR25 | Electrosonic/Sayal |
| R5 | | Resistor 2.2K ohm | Philips | CR25 | Electrosonic/Sayal |
| R6 | | Resistor 1K ohm/1 watt | Philips | CR25 | Electrosonic/Sayal |
| R7 | | Resistor 10K ohm | Philips | CR25 | Electrosonic/Sayal |
| R8 | | Resistor 10K ohm | Philips | CR25 | Electrosonic/Sayal |
| R9 | | Resistor 1M ohm | Philips | CR25 | Electrosonic/Sayal |
| R10 | | Resistor 470K ohm | Bourns | 3296W-1-504 | Electrosonic/Sayal |
| R11 | | Resistor 10K ohm | Philips | CR25 | Electrosonic/Sayal |
| TB1-P | | Terminal Block Plug 3 Pin | Wieland | 25.346.3353 | Wieland |
| TB1-S | | Terminal Block Socket 3 Pin | Wieland | 25.350.3353 | Wieland |
| TB2-P | | Terminal Block Plug 2 Pin | Wieland | 25.346.3253 | Wieland |
| TB2-S | | Terminal Block Socket 2 Pin | Wieland | 25.350.3253 | Wieland |
| TB3-P | | Terminal Block Plug 3 Pin | Wieland | 25.346.3353 | Wieland |
| TB3-S | | Terminal Block Socket 3 Pin | Wieland | 25.350.3353 | Wieland |
| TB4-P | | Terminal Block Plug 4 Pin | Wieland | 25.346.3453 | Wieland |
| TB4-S | | Terminal Block Socket 4 Pin | Wieland | 25.350.3453 | Wieland |
| TB5-P | | Terminal Block Plug 3 Pin | Wieland | 25.346.3353 | Wieland |
| TB5-S | | Terminal Block Socket 3 Pin | Wieland | 25.350.3353 | Wieland |
| TB6 | | Terminal Block 2 Pole | Wieland | 25.163.0253 | Wieland |
| TB6 (cont'd) | | Terminal Block 3 Pole | Wieland | 25.163.0353 | Wieland |
| TB7 | | Terminal Block 2 Pole | Wieland | 25,163.0253 | Wieland |
| U1 | | IC NAND Gate | Motorola | MC14093 | Electrosonic/Sayal |
| ICS1 | | IC Socket 14 Pin | Augat | 314-AG19DC | Electrosonic/Sayal |
| Z1 | | Diode Zener 12 v | Diodes Incorporated | 1N5242B | Electrosonic/Sayal |

ASSEMBLY: (30) System Interface Board
PN 01.333.200.001

| Name | Reference # | Description | Manufacturer | Manuf. Part # | Supplier |
|---|---|---|---|---|---|
| PCB | | Printed Circuit Board Blank | Apollo Circuits | 00.333.200.001 | Apollo Circuits |
| C1 | | Capacitor Electrolytic 100 uF/63 v Radial | Philips | 037-38101 | Electrosonic/Sayal |
| C2 | | Capacitor Electrolytic 10 uF/63 v Radial | Philips | 037-38109 | Electrosonic/Sayal |
| C3 | | Capacitor Electrolytic .1 uF Disc | Philips | CK-104 | Electrosonic/Sayal |
| CR1 | | Diode 1N914 | Nat'l Semiconductor | 1N914 | Electrosonic/Sayal |
| CR2 | | Diode 1N914 | Nat'l Semiconductor | 1N914 | Electrosonic/Sayal |
| CR3 | | Diode 1N914 | Nat'l Semiconductor | 1N914 | Electrosonic/Sayal |
| CR4 | | Diode 1N2004 | Nat'l Semiconductor | 1N2004 | Electrosonic/Sayal |
| CR5 | | Diode 1N2004 | Nat'l Semiconductor | 1N2004 | Electrosonic/Sayal |
| CR6 | | Diode 1N2004 | Nat'l Semiconductor | 1N2004 | Electrosonic/Sayal |
| CR7 | | Diode 1N2004 | Nat'l Semiconductor | 1N2004 | Electrosonic/Sayal |
| CR8 | | Diode 1N2004 | Nat'l Semiconductor | 1N2004 | Electrosonic/Sayal |
| CR9 | | Diode 1N2004 | Nat'l Semiconductor | 1N2004 | Electrosonic/Sayal |
| CR10 | | Diode 1N914 | Nat'l Semiconductor | 1N914 | Electrosonic/Sayal |
| CR11 | | LED Green | Lite-On | LTL-307G | Electrosonic/Sayal |
| CR12 | | LED Red | Lite-On | LTL-307Y | Electrosonic/Sayal |
| CR13 | | LED Yellow | Lite-On | LTL-307R | Electrosonic/Sayal |
| CR14 | | LED Green | Lite-On | LTL-307G | Electrosonic/Sayal |
| CR15 | | LED Green | Lite-On | LTL-307G | Electrosonic/Sayal |
| CR16 | | LED Green | Lite-On | LTL-307G | Electrosonic/Sayal |
| F1 | | Fuse 1 Amp | | | Electrosonic/Sayal |
| FC1 | | Fuse Clip End | Keystone | 3514 | Electrosonic |
| FC2 | | Fuse Clip End | Keystone | 3514 | Electrosonic |
| J1-H | | Ribbon Header 20 Pin | 3M | 3428-6302 | Electrosonic/Sayal |
| J1-S | | Ribbon Socket 20 Pin | 3M | 3421-6020 | Electrosonic/Sayal |
| J2-H | | Ribbon Header 20 Pin | 3M | 3428-6302 | Electrosonic/Sayal |
| J2-S | | Ribbon Socket 20 Pin | 3M | 3421-6020 | Electrosonic/Sayal |
| J3-H | | Ribbon Header 20 Pin | 3M | 3428-6302 | Electrosonic/Sayal |
| J3-S | | Ribbon Socket 20 Pin | 3M | 3421-6020 | Electrosonic/Sayal |
| J1-H | | Ribbon Header 10 Pin | 3M | 3446-6302 | Electrosonic/Sayal |
| J1-S | | Ribbon Socket 10 Pin | 3M | 3473-6010 | Electrosonic/Sayal |
| K1 | | Relay 24 vdc | Carlo Gavazzi | MZPA0024810 | Carlo Gavazzi |
| KB1 | | Relay Base | Carlo Gavazzi | ZH9 | Carlo Gavazzi |
| K2 | | Relay 24 vdc | Carlo Gavazzi | MZPA0024810 | Carlo Gavazzi |
| KB2 | | Relay Base | Carlo Gavazzi | ZH9 | Carlo Gavazzi |
| K3 | | Relay 24 vdc | Carlo Gavazzi | MZPA0024810 | Carlo Gavazzi |
| KB3 | | Relay Base | Carlo Gavazzi | ZH9 | Carlo Gavazzi |
| MOV1 | | Metal Oxide Varistor 150 V | Siemens | S07K150 | Electrosonic/Sayal |
| MOV2 | | Metal Oxide Varistor 35 V | Siemens | S07K30 | Electrosonic/Sayal |
| P1 | | Plug DB9 | ITT Cannon | ADEZ9SOL2 | Electrosonic/Sayal |
| P2 | | Plug DB9 | ITT Cannon | ADEZ9SOL2 | Electrosonic/Sayal |
| R1 | | Resistor 10 ohm/5 Watt | Philips | PH05UF | Electrosonic/Sayal |
| R2 | | Resistor 1K ohm | Philips | CR25 | Electrosonic/Sayal |
| R3 | | Resistor 470 ohm | Philips | CR25 | Electrosonic/Sayal |
| R4 | | Resistor 1K ohm | Philips | CR25 | Electrosonic/Sayal |
| R6 | | Resistor 220 ohm | Philips | CR25 | Electrosonic/Sayal |
| R7 | | Resistor 220 ohm | Philips | CR25 | Electrosonic/Sayal |
| R8 | | Resistor 220 ohm | Philips | CR25 | Electrosonic/Sayal |
| REG1 | | Regulator 12 v | Motorola | MC7812 | Electrosonic/Sayal |
| REGHS1 | | Regulator Heatsink (for 7812) | Wakefield | 273-AB | Electrosonic/Sayal |
| S1 | | Switch Test | Omron | B3F-4000 | Electrosonic/Sayal |
| TB1-P | | Terminal Block Plug 2 Pin | Wieland | 25.346.3253 | Wieland |
| TB1-S | | Terminal Block Socket 2 Pin | Wieland | 25.350.3253 | Wieland |
| TB2-P | | Terminal Block Plug 4 Pin | Wieland | 25.346.3453 | Wieland |
| TB2-S | | Terminal Block Socket 4 Pin | Wieland | 25.350.3453 | Wieland |
| TB3-P | | Terminal Block Plug 6 Pin | Wieland | 25.346.3653 | Wieland |
| TB3-S | | Terminal Block Socket 6 Pin | Wieland | 25.350.3653 | Wieland |
| TB4-P | | Terminal Block Plug 6 Pin | Wieland | 25.346.3653 | Wieland |
| TB4-S | | Terminal Block Socket 6 Pin | Wieland | 25.350.3653 | Wieland |
| TB5-P | | Terminal Block Plug 4 Pin | Wieland | 25.346.3453 | Wieland |
| TB5-S | | Terminal Block Socket 4 Pin | Wieland | 25.350.3453 | Wieland |
| TB6-P | | Terminal Block Plug 2 Pin | Wieland | 25.346.3253 | Wieland |
| TB6-S | | Terminal Block Socket 2 Pin | Wieland | 25.350.3253 | Wieland |
| TB7-P | | Terminal Block Plug 5 Pin | Wieland | 25.346.3553 | Wieland |
| TB7-S | | Terminal Block Socket 5 Pin | Wieland | 25.350.3553 | Wieland |
| TB8-P | | Terminal Block Plug 5 Pin | Wieland | 25.346.3553 | Wieland |
| TB8-S | | Terminal Block Socket 5 Pin | Wieland | 25.350.3553 | Wieland |
| TP1 | | Test Point | | | Electrosonic/Sayal |
| TP2 | | Test Point | | | Electrosonic/Sayal |
| TP3 | | Test Point | | | Electrosonic/Sayal |
| TP4 | | Test Point | | | Electrosonic/Sayal |

-continued

ASSEMBLY: (30) System Interface Board
PN 01.333.200.001

| Name | Reference # | Description | Manufacturer | Manuf. Part # | Supplier |
|---|---|---|---|---|---|
| U1 | | IC Opto Isolator (6 Pin) | Motorola | MCT2E | Electrosonic/Sayal |
| ICS1 | | IC Socket 6 Pin | Augat | 306-AG19DC | Electrosonic/Sayal |
| US1 | | Switch DIP 4 Pole (8 Pin) | Grayhill | 78K01S | Electrosonic/Sayal |
| ICS2 | | IC Socket 8 Pin | Augat | 308-AG19DC | Electrosonic/Sayal |

ASSEMBLY: (7)Module Assembly
PN

| Name | Reference # | Description | Manufacturer | Manuf. Part # | Supplier |
|---|---|---|---|---|---|
| BR1 | 7d | Bracket for holding Clubs | Norsteel | C3NMA1 | Norsteel |
| Enclosure | 7m | Enclosure | Norsteel | C3NMA2 | Norsteel |
| F1 | 7j | Fan Cooling | Nidec Alpha V | TA450 | Active Electronics |
| HS1 | 7e | Heat Strip 400 Watt | ASB Heating Elements | | ASB Heating Elements |
| LL1 | 7c | Lid Lock and Latch Assembly c/w Tank Lid | Norsteel | C3NMA3 | Norsteel |
| MP1 | | Mounting Plate for Components | Norsteel | C3NMA4 | Norsteel |
| PCB1 | 7i | Module Interface Board | AMS | 01.333.200.002 | AMS |
| PCB2 | Th | Transducer Driver Board | TSI | C3TMA1 | TS1 |
| T1 | 7f | Tank c/w Transducers | TSI | C3TMA2 | TS1 |
| TS1 | 7y | Temperature Sensor 2 Stage | FSP | 344395 | |
| TS2 | 7x | Temperature Sensor 1 Stage | FSP | 610008 | |
| Tank | 7a | Stainless Steel Tank | Volrath | 78820 | Hamilton Kitchen App. |
| Tank Lid | 7b | Stainless Steel Tank Lid | Volrath | 79220 | |

All measurements disclosed herein are at standard temperature and pressure, at sea level on Earth, unless indicated otherwise.

The foregoing embodiments are presented by way of example only; the scope of the present invention is to be limited only by the following claims.

I claim:

1. Apparatus for cleaning golf equipment comprising:

four bays for containing water and chemical cleaning agents;

ultrasonic equipment for ultrasonically agitating devices placed in the bays;

heating means for heating water in the bays; and activating means for activating the ultrasonic equipment, wherein each bay is of a sufficient size to hold a full set of golf clubs, and all bays can run simultaneously.

2. The apparatus of claim 1, including computer controlled means for determining the next available bay and for starting a lighted button above the bay to flash.

3. The apparatus of claim 1, including computer controlled means for constantly maintaining the four bays at a full level with water and chemical.

4. The apparatus of claim 1, including computer controlled means for automatically filling and draining the bays.

5. The apparatus of claim 1, further comprising:

a lid device for each bay for preventing the bay from being used when no token is received by the apparatus to operate the bay.

6. The apparatus of claim 1, further comprising:

control means for automatically turning the apparatus on in the morning and off in the evening at pre-set times.

7. Apparatus for cleaning golf equipment comprising:

four bays for containing water and chemical cleaning agents;

ultrasonic equipment for ultrasonically agitating devices placed in the bays;

heating means for heating water in the bays;

activating means for activating the ultrasonic equipment;

means for determining a proper temperature for the bays;

a ready light which comes on when all bays that can be operated are at a proper temperature; and means for rejecting tokens when the ready light is not on.

8. Apparatus for cleaning golf equipment comprising:

four bays for containing water and chemical cleaning agents;

ultrasonic equipment for ultrasonically agitating devices placed in the bays;

heating means for heating water in the bays;

activating means for activating the ultrasonic equipment; and computer means for automatically taking a defective bay out of service and eliminating the possibility of a token turning on this bay or a green light above it.

9. The apparatus of claim 8, wherein each bay is of a sufficient size to hold a full set of golf clubs.

10. The apparatus of claim 8, wherein all bays can run simultaneously.

11. The apparatus of claim 1, including control means for operating the bays independently of one another.

12. The apparatus of claim 1, including control means for turning on and shutting off the bays independently of one another.

13. Computer controlled apparatus for cleaning golf equipment comprising:

multiple bays for containing water and chemical cleaning agents;

ultrasonic equipment for ultrasonically agitating devices placed in the bays;

heating means for heating water in the bays; and activating means for activating the ultrasonic equipment, wherein each bay is of a sufficient size to hold a full set of golf clubs, and all bays can run simultaneously.

14. The apparatus of claim 13, including computer controlled means for determining the next available bay and for starting a lighted button above the bay to flash.

15. The apparatus of claim 13, including computer controlled means for constantly maintaining the bays at a full level with water and chemical.

16. The apparatus of claim 13, including computer controlled means for automatically filling and draining the bays.

17. The apparatus of claim 13, including control means for operating the bays independently of one another.

18. The apparatus of claim 13, including control means for turning on and shutting off the bays independently of one another.

19. The apparatus of claim 13, further comprising:

a lid device for each bay for preventing the bay from being used when no token is received by the apparatus to operate the bay.

20. The apparatus of claim 13, further comprising:

control means for automatically turning the apparatus on in the morning and off in the evening at pre-set times.

21. Computer controlled apparatus for cleaning golf equipment comprising:

multiple bays for containing water and chemical cleaning agents;

ultrasonic equipment for ultrasonically agitating devices placed in the bays;

heating means for heating water in the bays;

activating means for activating the ultrasonic equipment;

means for determining a proper temperature for the bays;

a ready light which comes on when all bays that can be operated are at a proper temperature; and means for rejecting tokens when the ready light is not on.

22. Computer controlled apparatus for cleaning golf equipment comprising:

multiple bays for containing water and chemical cleaning agents;

ultrasonic equipment for ultrasonically agitating devices placed in the bays;

heating means for heating water in the bays;

activating means for activating the ultrasonic equipment; and computer means for automatically taking a defective bay out of service and eliminating the possibility of a token turning on this bay or a green light above it.

23. The apparatus of claim 22, wherein each bay is of a sufficient size to hold a full set of golf clubs.

24. The apparatus of claim 22, wherein all bays can run simultaneously.

* * * * *